US009026011B2

(12) United States Patent
Kubo et al.

(10) Patent No.: US 9,026,011 B2
(45) Date of Patent: May 5, 2015

(54) IMAGE FORMING APPARATUS

(71) Applicant: Canon Kabushiki Kaisha, Tokyo (JP)

(72) Inventors: Kenta Kubo, Kamakura (JP); Juun Horie, Tokyo (JP); Shuji Moriya, Yokohama (JP); Tomoaki Miyazawa, Tokyo (JP); Hirokazu Usami, Kawasaki (JP); Tomohito Ishida, Saitama (JP); Manami Haraguchi, Yokohama (JP); Takeshi Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 70 days.

(21) Appl. No.: 13/776,822

(22) Filed: Feb. 26, 2013

(65) Prior Publication Data

US 2013/0223861 A1 Aug. 29, 2013

(30) Foreign Application Priority Data

Feb. 27, 2012 (JP) ..... 2012-040054

(51) Int. Cl.
*G03G 15/09* (2006.01)
*G03G 15/08* (2006.01)

(52) U.S. Cl.
CPC .... *G03G 15/0849* (2013.01); *G03G 2215/0648* (2013.01); *G03G 15/0907* (2013.01)

(58) Field of Classification Search
CPC ..... G03G 15/0907; G03G 15/0935; G03G 2215/0648
USPC ..... 399/269, 270
See application file for complete search history.

(56) References Cited

U.S. PATENT DOCUMENTS

| | | | | |
|---|---|---|---|---|
| 5,694,637 | A * | 12/1997 | Yoshino et al. | 399/38 |
| 6,269,235 | B1 * | 7/2001 | Nishiyama | 399/267 |
| 6,925,269 | B2 * | 8/2005 | Hibino | 399/55 |
| 7,962,076 | B2 | 6/2011 | Endo et al. | |
| 8,019,260 | B2 | 9/2011 | Endo et al. | |
| 2005/0079434 | A1 | 4/2005 | Suzuki et al. | |
| 2007/0202430 | A1 | 8/2007 | Suzuki et al. | |
| 2008/0247788 | A1 * | 10/2008 | Ayaki et al. | 399/321 |

(Continued)

FOREIGN PATENT DOCUMENTS

| | | |
|---|---|---|
| JP | 62-2313 B | 1/1987 |
| JP | 2000-98716 A | 4/2000 |

(Continued)

*Primary Examiner* — Gregory H Curran
(74) *Attorney, Agent, or Firm* — Fitpatrick, Cella, Harper & Scinto

(57) ABSTRACT

An image forming apparatus includes a photosensitive member, a first developer carrying member for carrying a developer comprising toner and a carrier for developing an electrostatic image formed on the photosensitive member, and a second developer carrying member for carrying the developer received from the first developer carrying. The second developer carrying member is disposed downstream of the first developer carrying member with respect to a rotational direction of the photosensitive member. In addition, a voltage source applies a developing bias voltage to the first developer carrying member and second developer carrying member, and a driving device rotates the first developer carrying member at a peripheral speed higher than that of the photosensitive member and rotates the second developer carrying member at a peripheral speed which is higher than that of the photosensitive member and which is lower than that of the first developer carrying member.

11 Claims, 16 Drawing Sheets

(56) References Cited

U.S. PATENT DOCUMENTS

2009/0104554 A1* 4/2009 Otsuka et al. ..... 430/108.3
2013/0216263 A1* 8/2013 Miyazawa et al. ..... 399/167

FOREIGN PATENT DOCUMENTS

JP 2005-115283 A 4/2005
JP 2005-352226 A 12/2005

* cited by examiner

IMAGE FORMING APPARATUS

FIELD OF THE INVENTION AND RELATED ART

The present invention relates to an image forming apparatus which transfers developer from its first development roller to its second development roller while it forms a visible image on its photosensitive member by forming an electrostatic latent image on the photosensitive member and developing the electrostatic latent image with the use of developer. More specifically, it relates to how to control the second development roller in order to prevent an image forming apparatus from outputting an image which is foggy across its background areas.

An image forming apparatus which forms an electrostatic image on its photosensitive member, develops the electrostatic image into a toner image with the use of developer made up of toner and carrier, directly transfers the toner image from the photosensitive member onto a sheet of recording medium, or indirectly transfers the toner image from the photosensitive member onto a sheet of recording medium by way of its intermediary transfer member, and fixes the toner image on the sheet of recording medium to the sheet of recording medium by applying heat and pressure to the sheet of recording medium and the toner image thereon, is widely used.

In recent years, it has come to be desired to operate an image forming apparatus at a process speed which is no less than 500 mm/sec, in order to improve the image forming apparatus in its productivity, which is evaluated in terms of the number of images (prints) per minutes (PPM). Thus, in order to ensure sufficient development property or performance even if an image forming apparatus is operated at an extremely high process speed, for example, no less than 500 mm/sec, a developing device which uses two development rollers has been put to practical use (Japanese Laid-open Patent Application 2000-098716 (Patent Document 1)). This type of developing device, which develops an electrostatic image on the peripheral surface of a photosensitive member with the use of developer, transfers developer from its first development roller to its second one while developing the electrostatic image. In the case of the developing device of the two roller type disclosed in Japanese Laid-open Patent Application Sho62-2313 (Patent Document 2), in order to prevent an electrostatic image from being unevenly developed by the sweeping action of the magnetic brush, the upstream development roller, in terms of the moving direction of the peripheral surface of the photosensitive member, is made higher in peripheral velocity than the photosensitive member, and, that of the downstream development roller is made lower than the peripheral velocity of the photosensitive member.

Japanese Laid-open Patent Application 2005-352226 states that using carrier, the volume resistivity of which is no less than $5\times10^{7}$ [Ω·cm] and no more than $1\times10^{12}$ [Ω·cm] is effective to enhance the development property even if an image forming apparatus is operated a process speed of no less than 500 mm/sec. Further, Japanese Laid-open Patent Application 2005-115283 states that using a photosensitive member based on amorphous silicon (which hereafter may be referred to simply as a-Si photosensitive member) which is higher in surface hardness than a conventional photosensitive member based on OPC (which hereafter may be referred to simply as OPC photosensitive member) is effective to minimize the problem that increasing an image forming apparatus in process speed tends to accelerate the speed at which the peripheral surface of the photosensitive member is frictionally worn (abraded).

The experiment (which will be described later in detail) in which the second comparative developing device 2 was tested, confirmed that in a case of an image forming apparatus which employs a combination of an a-Si photosensitive member and a developing device of the two developer roller type, using carrier which is low in electrical resistance ensures that even if the image forming apparatus is operated at a process speed of no less than 500 mm/sec, an electrostatic latent image is satisfactorily developed.

This experiment, however, revealed that as long as the image forming apparatus is operated at the normal process speed, the combination of the abovementioned image forming apparatus (developing device) and carrier is not problematic, but, it becomes problematic as the apparatus is substantially increased in process speed relative to the normal one. That is, as it is used for an image forming operation for continuously forming a substantially number of images (prints), the developer in the apparatus decreases in toner ratio, and as the developer decreases in toner ratio, the apparatus tends to output an image which is foggy across its background area. Further, the experiment revealed that reducing the development roller in peripheral velocity prevents the image forming apparatus from outputting an image having foggy background areas, but reduces the developing device in performance, and therefore, makes the image forming apparatus output an image of low quality.

Here, "background fogging" means the phenomenon that toner adheres to the areas of an electrostatic image formed on the peripheral surface of a photosensitive member, which correspond to the background areas of an original, that is, the areas of the peripheral surface of the photosensitive member, to which toner is not to adhere, and therefore, an image forming apparatus outputs an image which is slightly darkened (colored) across its background areas. If the density of the background areas of an image is higher than a level beyond which the darkening (coloring) is noticeable to naked eyes, the image is labeled as an image having foggy background areas, that is, a defective image. As for the phenomenon that developer reduces in toner ratio while a substantial number of images are continuously formed, it tends to occur as the toner in developer reduces in chargeability, as a substantial number of images which are relatively high in toner consumption are continuously formed; as an image forming apparatus is operated in an environment which is high in humidity; and the like.

SUMMARY OF THE INVENTION

Thus, the primary object of the present invention is to provide an image forming apparatus which employs a developing device of the two roller type, which can remain satisfactory in the development property or performance, being therefore capable of preventing the image forming apparatus from outputting a defective image, more specifically, an image having foggy background areas, even if the image forming apparatus is substantially increased in process speed.

According to an aspect of the present invention, there is provided an image forming apparatus comprising a photosensitive member; a first developer carrying member for carrying a developer comprising toner and a carrier having a volume resistivity lower than that of the toner and for developing an electrostatic image formed on said photosensitive member by rubbing said photosensitive member with the developer carried on said first developer carrying member; a second developer carrying member for carrying the developer received from said first developer carrying member and for developing the electrostatic image by rubbing said photosensitive member with the developer carried on said second developer carrying member; a voltage source for applying a developing bias voltage comprising a DC voltage component and an AC voltage component to said first developer carrying member and second developer carrying member; and a driving device for rotating said first developer carrying member at a peripheral speed higher than that of said photosensitive member and for rotating said second developer carrying member at a peripheral speed which is higher than that of said photosensitive member and which is lower than that of said first developer carrying member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the embodiments of the present invention are described in detail with reference to the appended drawings. The following embodiments of the present invention are not intended to limit the present invention in scope. That is, the present invention is also applicable to image forming apparatuses which are partially or entirely different in structure from those in the following embodiments, as long as they are structured so that their downstream development roller in terms of the moving direction of the peripheral surface of their photosensitive member is set slower in peripheral velocity than their upstream one.

That is, the present invention is applicable to any image forming apparatus, as long as the image forming apparatus is structured so that it is provided with two development rollers (development sleeves) on which two-component developer is borne in the form of a magnetic brush, regardless of their method for forming an electrostatic image and method for transferring a toner image, and also, whether they employ an intermediary transfer roller and/or recording medium conveying member, and the type of their fixing device. In the following description of the embodiments of the present invention, only the primary portions related to the formation and transfer of a toner image are described. However, the present invention is also applicable to various image forming apparatuses other than those in the following embodiment, more specifically, various printer, copying machines, facsimile machines, and multifunction machines capable of performing two or more functions of the preceding machines, which are combinations of the image forming apparatuses (developing devices) in the following embodiments of the present invention, and additional devices, equipment, external case (shell), etc.

<Image Forming Apparatus>

Figure 1:
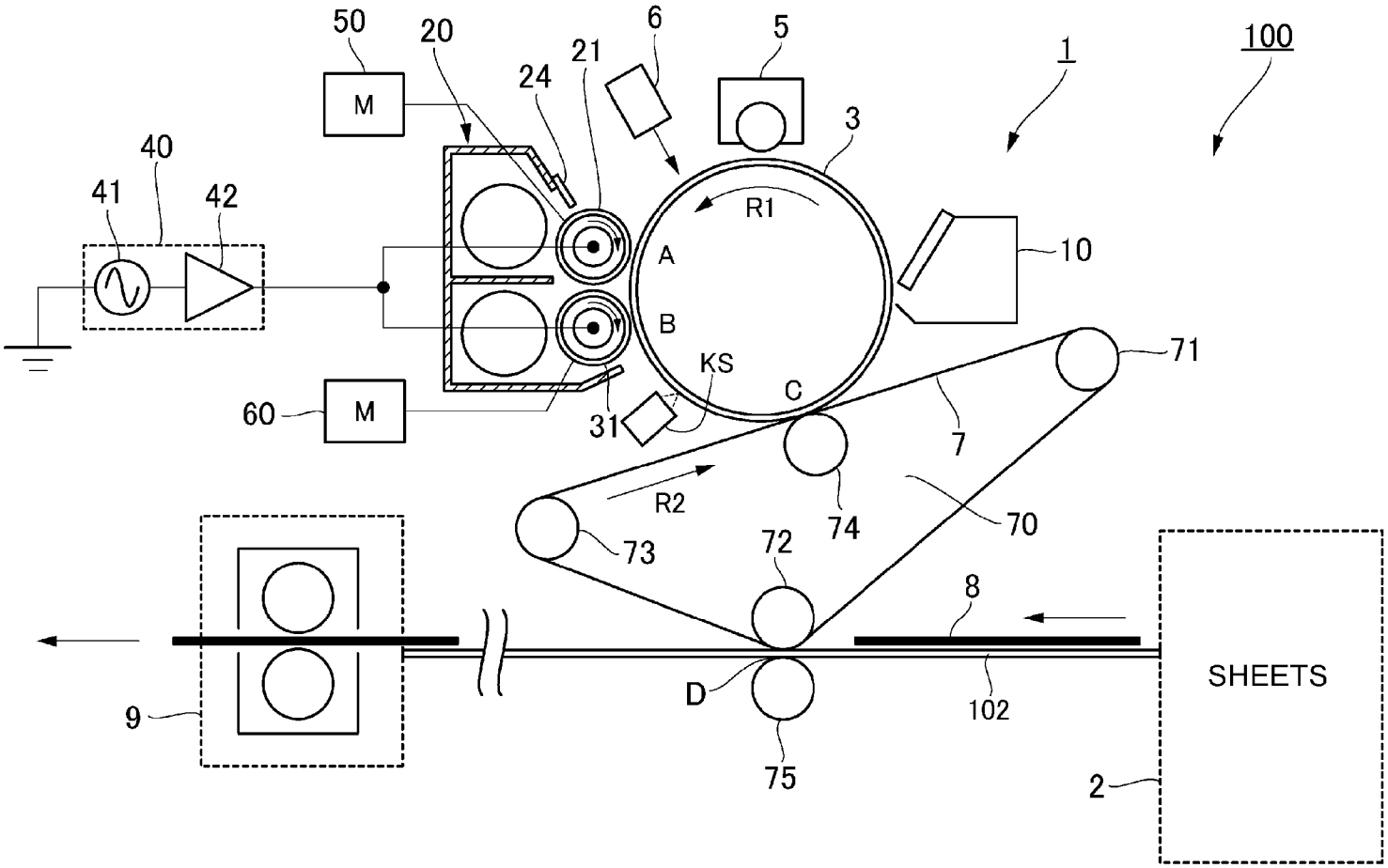
FIG. 1 is a schematic sectional view of a typical image forming apparatus to which the present invention is applicable. It shows the general structure of the apparatus.

FIG. 1 is a schematic sectional view of a typical image forming apparatus to which the present invention is applicable. It shows the general structure of the apparatus. Referring to FIG. 1, the image forming apparatus 100 is a high-speed monochromatic printer, which transfers a toner image in its image forming section 1, and transfers the toner image onto a sheet of recording medium by way of its intermediary transfer belt.

The image forming section 1 has a photosensitive drum 3. It also has a charging device 5, an exposing device 6, a developing device 20, a primary transfer roller 74, and a drum cleaning device 10, which are positioned in the adjacencies of the peripheral surface of the photosensitive drum 3.

The photosensitive drum 3 is a photosensitive drum of the so-called amorphous silicon type (which hereafter may be referred to simply as a-Si photosensitive drum). That is, it is made up of an electrically conductive substrate, and a photosensitive layer formed of amorphous silicon (a-Si) formed on the peripheral surface of the substrate. A photosensitive member based on a-Si is very hard. Therefore, it is significantly smaller in the amount by which a photosensitive member is reduced in the length of service life because of its abrasion by developer, which is accelerated by the recent increase in the process speed of an image forming apparatus. Thus, it is significantly longer in the length of its service life than a photosensitive member based on organic photoconductor (OPC). In other words, from the standpoint of increasing an image forming apparatus in process speed, a photosensitive member based on a-Si is far more accommodating than a photosensitive member based on OPC. The photosensitive drum 3 is rotationally driven in the direction indicated by an arrow mark R1 at a preset process speed by a motor.

The charging device 5 uniformly charges the peripheral surface of the photosensitive drum 3 to preset polarity and potential level. The charging device 5 is of the so-called magnetic brush type. That is, it is structured so that its magnetic brush rubs the peripheral surface of the photosensitive drum 3. Therefore, it is significantly superior to a charging device which does not rely on a magnetic brush, from the standpoint of preventing the occurrence of the image deletion, and microscopic nonuniformity in charge, which are attributable to byproducts of electrical discharge.

The exposing device 6 writes an electrostatic image of an original, on the peripheral surface of the photosensitive drum 3 by selectively reducing, in surface potential level, various points of the uniformly charged portion of the peripheral surface of the photosensitive drum 3 by scanning, with the use of its rotational mirror, the uniformly charged portion of the peripheral surface of the photosensitive drum 3 with a beam of laser light it emits while modulating (turning on or off) the beam with the image formation signals obtained by translating the data of the monochromatic image into electrical signals. The exposing device 6 does not need to be a digital one, such as a laser scanner, an LED array, and the like. It may be an analog one, for example, an exposing device which projects the image of an original onto the uniformly charged portion of a photosensitive member.

The developing device 20 develops an electrostatic image on the peripheral surface of the photosensitive drum 3 by transferring toner onto the peripheral surface of the photosensitive drum 3, in the development areas A and B. The primary transfer roller 74 transfers (primary transfer) the toner image on the photosensitive drum 3 onto the intermediary transfer belt 7 of an intermediary transfer unit 70, in the primary transfer station C; as DC voltage, that is, voltage which is opposite in polarity from the toner charge, is applied to the primary transfer roller 74, the toner image on the photosensitive drum 3 is transferred onto the intermediary transfer belt 7. The drum cleaning device 10 removes the transfer residual toner, that is, the toner which failed to be transferred from the peripheral surface of the photosensitive drum 3 onto the intermediary transfer belt 7, from the peripheral surface of the photosensitive drum 3 by scraping the peripheral surface of the photosensitive drum 3 with its cleaning blade.

The intermediary transfer belt 7 is suspended and kept stretched by a belt driving roller 71, a belt backing roller 72, and an idler roller 73. It is moved by the driving roller 71 in the direction indicated by an arrow mark R2 at roughly the same velocity as the peripheral velocity of the photosensitive drum 3. It remains pinched between the photosensitive drum 3 and primary transfer roller 74. As a toner image is transferred onto the intermediary transfer belt 7, the transfer belt 7 conveys the toner image to the secondary transfer station D.

The sheet feeding section 2 is capable of feeding sheets of recording medium one by one into the main assembly of the image forming apparatus 100 at a substantially higher speed than a conventional sheet feeding section. It feeds each sheet 8 of recording medium onto a transfer belt 102, which feeds the sheet 8 to the secondary transfer station D with such a timing that the sheet 8 arrives at the second transfer station D at the same time as the leading edge of the toner image on the intermediary transfer belt 7. The transfer belt 102 is for facilitating the sheet 8 to separate from the photosensitive drum 3 in the secondary transfer station D. It is an endless belt. However, FIG. 1 illustrates only a part of the transfer belt 102.

The secondary transfer roller 75 is for transferring (secondary transfer) the toner image on the intermediary transfer belt 7, onto the sheet 8 of recording medium on the transfer belt 102; as DC voltage which is opposite in polarity from the toner charge is applied to the secondary transfer roller 75, the toner image on the intermediary transfer belt 7 is transferred onto the sheet 8 on the transfer belt 102. After the transfer of the toner image onto the sheet 8 of recording medium, the sheet 8 is separated from the transfer belt 102, and is conveyed to the fixing device 9, which fixes the toner image (unfixed toner image) to the surface of the sheet 8 by melting the toner as it conveys the sheet 8 through the fixing device 9 while applying heat and pressure to the sheet 8 and the toner image thereon. After the fixation of the toner image to the surface of the sheet 8, the sheet 8 is discharged as a finished image (print) from the main assembly of the image forming apparatus 100.

<Developing Device>

Figure 2:
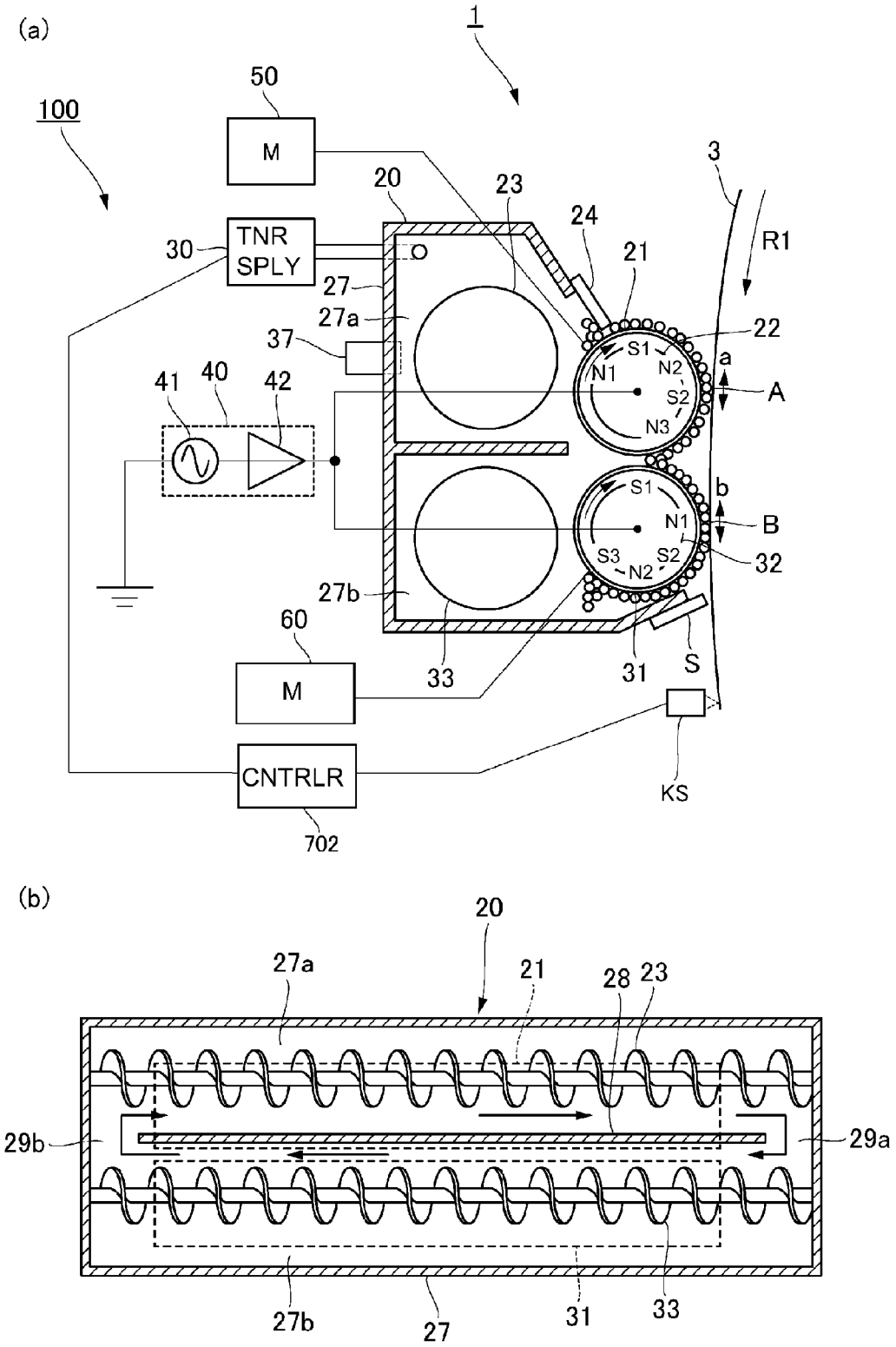
FIG. 2(*a*) is a sectional view of the developing device to which the present invention is applicable, at plane perpendicular to the axial line of a developer conveyance member, and FIG. 2(*b*) is a sectional view of the same developing device as the one shown in FIG. 2(*a*), at a horizontal plane which coincides with both the developer conveyance members. They show the general structure of the device.
Figure 3:
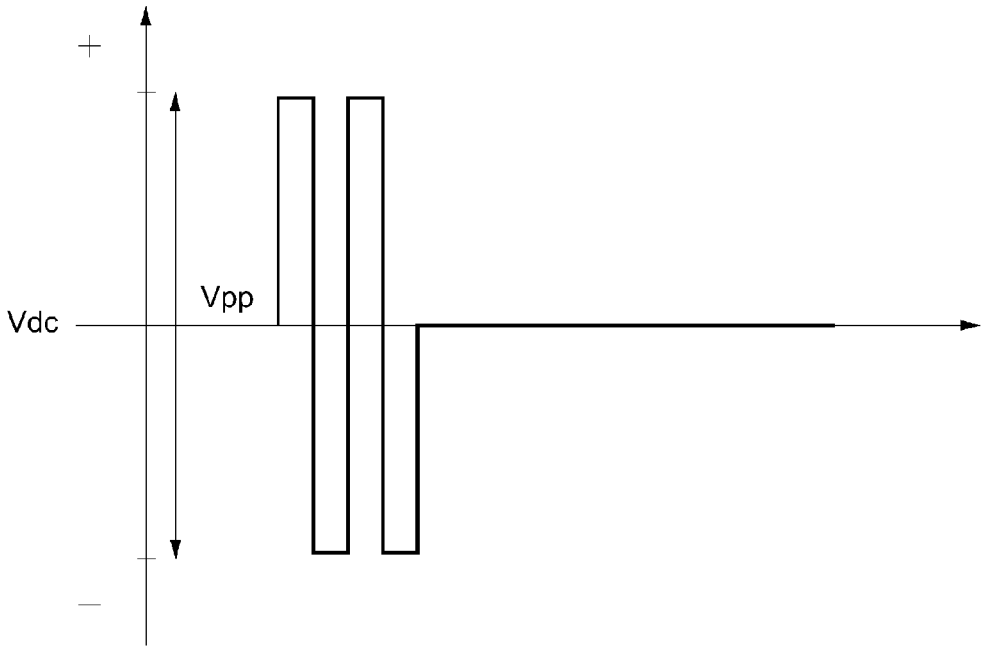
FIG. 3 is a drawing for describing development bias.

FIG. 2 is a schematic drawing of a typical developing device to which the present invention is applicable. FIG. 3 is a drawing for describing development bias. Referring to FIG. 1, the image forming apparatus 100 is of the so-called image exposure type. That is, the method which the image forming apparatus 100 uses to form an electrostatic image is such a method that exposes the uniformly charged portion of the peripheral surface of the photosensitive drum 3 according to the information of the image to be formed. The image forming apparatus 100 (developing device) is of the so-called reversal development type. That is, it adheres negatively charged toner to a negatively charged electrostatic image.

Generally speaking, one of the reasons why it is difficult to increase an image forming apparatus in process speed is that increasing the image forming apparatus in process speed reduces the development property. More specifically, as an image forming apparatus is increased in process speed, it reduces in the frequency (number of times or length of time) with which its photosensitive drum comes into contact with developer (magnetic brush) in its development area. Consequently, it becomes impossible for the development roller to supply the development area with toner by an amount necessary for proper development. In addition, as an image forming apparatus is increased in process speed, the image forming apparatus reduces in the length of time toner (developer) is subjected to the development bias in the development area, that is, the actual length of time for development.

Referring to FIG. 2(*a*), the developing device 20 is of the high speed type. It employs a pair of development rollers 21 and 31 to increases itself in the frequency with which the electrostatic image on the photosensitive drum 3 comes into contact with the developer in the device. In order to minimize the developing device 20 in size while providing it with two development rollers, and also, to ensure that the photosensitive drum 3 is sufficiently supplied with developer, the developing device 20 is structured so that the two development rollers 21 and 31 are vertically stacked. Thus, after toner is supplied to the photosensitive drum 3 from the developer layer on the upstream development roller, in terms of the rotational direction of the photosensitive drum 3, the developer layer is transferred onto the downstream development roller 31, from which the electrostatic image on the photosensitive drum is supplied with toner for the second time.

The developing means container 27 of the developing device 20 is provided with an opening, through which the pair of development rollers 21 and 31 are exposed to the peripheral surface of the photosensitive drum 3 while being rotated. The developing device 20 is provided with a pair of stationary magnets, which are positioned in the hollows of the development rollers 21 and 31, respectively. The development roller 21 is rotationally driven in the clockwise direction indicated by an arrow mark by a motor 50, and the development roller 31 is rotationally driven in the clockwise direction indicated by another arrow mark by a motor 60. The photosensitive drum 3 is rotated in the counterclockwise direction. Thus, the direction in which the peripheral surface of the development roller 21 and the peripheral surface of the development roller 31 move in the development areas A and B, respectively, are the same as the direction in which the peripheral surface of the photosensitive drum 3 moves in the development areas A and B.

Next, referring to FIG. 2(*b*), the developing means container 27 has a development chamber 27*a* and a developer stirring chamber 27*b*, which are separated from each other by a partition wall 28. The development chamber 27*a* is provided with a development screw 23, and the developer stirring chamber 27*b* is provided with a developer stirring screw 33. The development screw 23 and stirring screw 33 circularly move the developer in the developing means container 27 while stirring the developer. The developer is two-component developer, which is a mixture of toner and carrier. The developer in the developing device 20 is replenished with toner by an amount equal to the amount by which the toner in the developer is consumed for development while the developer is circularly moved in the developing means container. It is repeatedly used for developing an electrostatic image by being supplied to the electrostatic image on the peripheral surface of the photosensitive drum 3 by way of the development rollers 21 and 31, while the toner in the developer is evenly charged by the friction between the toner and carrier as the developer is stirred by the two screws 23 and 33.

As the development roller 21 is rotated in the direction indicated by the arrow mark, the developer in the developing means container 27 is borne on the peripheral surface of the development roller 21 by the magnetic force generated by the magnetic member 22. After being borne on the peripheral surface of the development roller 21, the developer is formed by a developer regulating member 24 into a developer layer which is uniform in thickness. That is, the developer is uniformly coated on the peripheral surface of the development roller 21 to a preset thickness, and is conveyed to the development area A, in which it is made to crest in the form of a brush (magnetic brush) by the magnetic field generated by the development pole S2 of the magnetic member 22, and rubs the peripheral surface of the photosensitive drum 3.

A development power source 40 applies oscillating voltage, which is a combination of a DC voltage Vdc, and an AC voltage which is Vpp in peak-to-peak voltage, to the development rollers 21 and 31. It has a waveform signal generating device 41, and an amplifier circuit 42 which amplifies the output signal from the waveform generating device 41 and applies the amplified signal (oscillating voltage) to the development rollers 21 and 31. As the oscillating voltage is applied to the development rollers 21 and 31, the toner in the magnetic brush formed of the two-component developer is driven by the electric field generated by the oscillating voltage, being thereby transferred onto the electrostatic image (its exposed portion) on the peripheral surface of the photosensitive drum 3. Consequently, the electrostatic image on the peripheral surface of the photosensitive drum 3 is developed into a toner image, that is, a visible image formed of the toner.

After the toner in the developer on the upstream development roller 21 is consumed by a certain amount in the development area A, the developer is transferred from the upstream developer roller 21 onto the downstream development roller 31, by the developer transfer pole (N3-S1) of the magnetic members 22 and 32. After being transferred onto the downstream development roller 31, the developer on the development roller 31 is conveyed to the development area B by the rotation of the development roller 31 in the direction indicated by the arrow mark, and rubs the peripheral surface of the photosensitive drum 3 by being crested in the form of a brush (magnetic brush). As the magnetic brush formed of the developer on the development roller 31 rubs the peripheral surface of the photosensitive drum 3, the toner in the magnetic brush transfers onto the electrostatic image (its exposed portion) on the peripheral surface of the photosensitive drum 3 by being driven by the electric field formed by the aforementioned oscillating voltage, adding to the toner having adhered to the toner in the toner image on the peripheral surface of the photosensitive drum 3; it develops the electrostatic image on the photosensitive drum 3 for the second time. After the toner in the developer 1 is consumed in the development area B, the developer 1 is ripped away from the development roller 31 by the toner removal pole S3 of the magnetic member 32, and then, is recovered by the stirring screw 33.

Next, referring to FIG. 3, the oscillating voltage is a combination of the DC voltage Vdc, and the AC voltage which is Vpp in peak-to-peak voltage. The waveform of the AC voltage is rectangular; it is made up of portions which are higher in amplitude than the DC voltage, and portions which are lower in amplitude than the DC voltage. The AC voltage which is rectangular in waveform is 1.6 kV in peak-to-peak voltage Vpp, and 1.5 kHz in frequency. If the AC voltage applied to the development rollers 21 and 31 of the developing device 20 is higher than 1.8 kV in the peak-to-peak voltage Vpp, the electric field to which the development areas A and B are subjected is likely to be strong enough to leave traces of electrical discharge on the peripheral surface of the photosensitive drum 3. On the other hand, if the peak-to-peak voltage Vpp is no more than 0.7 kV, it is likely to be difficult for the toner to be repositioned on the peripheral surface of the photosensitive drum 3. Thus, the image forming apparatus 100 is likely to output an image which appears rough in texture. Therefore, the peak-to-peak voltage Vpp of the AC voltage which is rectangular in waveform is desired to be in a range of 0.7-1.8 kV.

In terms of the moving direction of the peripheral surface of each of the development rollers 21 and 31, the dimension a of the development area A, that is, the area of contact between the peripheral surface of the photosensitive drum 3 and the developer layer (magnetic brush) on the development roller 21 was roughly 4 mm, and the dimension b of the development area B, that is, the area of contact between the peripheral surface of the photosensitive drum 3 and the developer layer (magnetic brush) on the development roller 31 was roughly 2 mm. Increasing the development areas A and B in the dimensions a and b, respectively, increases the frequency with which the developer contacts the peripheral surface of the photosensitive drum 3, which in turn improves the developing device 20 in performance in terms of the amount by which the developing device 20 can supply the electrostatic image on the photosensitive drum 3 with toner. It, however, increases the amount by which the carrier in the developer adheres to the photosensitive drum 3 and/or causes the image forming apparatus 100 to output an image which appears coarse in texture. Thus, the dimensions a and b of the development areas A and B, respectively, are desired to be in a range of 1-5 mm.

As for the present invention is concerned, the development rollers 21 and 31 may be rotated in the counterclockwise direction so that the peripheral surface of the development roller 21 and that of the development roller 31 move in the opposite direction from the direction in which the peripheral surface of the photosensitive drum 3 moves in the corresponding areas of contact, respectively.

<Control of Toner Charge>

The control section 702 forms an electrostatic image in a preset pattern for every 100 images (prints), and develops the electrostatic image into a toner image (test patch) having the preset pattern. Then, it detects the amount by which light is reflected by the test patch, with the use of an optical sensor KS, and calculates the amount of toner per unit area of the test patch, based on the detected amount of the light reflected by the test patch.

If the amount of toner on the test patch per unit area is no more than a referential value, the control section 702 increases the rate at which the developing device 20 is replenished with toner, in order to increase, in toner ratio, the developer in the developing device 20. As the developer increases in the amount of toner therein, the toner in the developer reduces in the frequency with which it rubs against carrier, and therefore, reduces in the amount of electrical charge, which in turn increases the amount by which the toner in the developer is transferred onto the exposed portion of the electrostatic image. Consequently, the amount by which toner is adhered to the exposed portions of the electrostatic image per unit area is restored to the referential value.

If the amount of toner per unit area of the test patch is no less than the referential value, the control section 702 reduces the amount by which the developing device 20 is supplied with toner, in order to reduce the developer in the developing device 20 in toner ratio. As the developer reduces in toner ratio, the frequency with which the toner in the developer is rubbed by the carrier, which in turn increases the toner in the amount of electrical charge. Consequently, the amount by which toner is adhered to the exposed portions of the electrostatic image reduces, that is, it is restored to the referential value.

If the toner in the developer reduces in chargeability during an image forming operation in which a substantial number of images are continuously formed, an image forming operation in which a substantial number of images which are high in toner consumption are continuously formed, an image forming operation carried out in an environment which is high in temperature and humidity, and/or the like image forming operation, the developing device 20 is reduced in the amount by which it is replenished with toner. Therefore, the developer in the developing device 20 reduces in toner ratio. Consequently, the developer borne by the development rollers 21 and 31 reduces in toner ratio, which in turn increases the frequency with which the peripheral surface of the photosensitive drum 3 possibly comes into contact with the carrier in the magnetic brush.

Incidentally, the control section 702 measures the toner ratio in the developer with the use of a TD ratio sensor 37, which detects the permeability of the developer, while the developer is circulated through the developing device 20. If the developing device 20 is continuously reduced in the amount by which it is replenished with toner, the developer in the developing device 20 continuously reduces in toner ratio. If the toner ratio of the developer in the developing device 20 reduces below the preset value preset as the bottom limit, the control section 702 temporarily stops the ongoing image forming operation, and idles the developing device 20 to restore the toner in the amount of electrical charge.

<Volume Resistivity of Carrier>

From the standpoint of minimizing the reduction in the performance of the developing device 20, which is attributable to the increase in process speed, it is desired to reduce the carrier in electrical resistance. However, if the carrier is low in electrical resistance, it is easier for the electrical charge (counter charge) accumulated by the friction between the toner and carrier to attenuate. Therefore, the electrostatic attraction between the carrier and toner is weaker than when the carrier is high in electrical resistance. Thus, when the carrier is low in electrical resistance, it is easier for the toner to separate from the carrier, and transfer onto the electrostatic image on the photosensitive drum 3. Therefore, when the carrier is low in electrical resistance, the developing device 20 remains satisfactory in performance even at a higher process speed which makes shorter the length of time the developer (magnetic brush) on the development rollers 21 an 31 can remain in contact with the peripheral surface of the photosensitive drum 3 in the development areas A and B.

The carrier in the developing device 20 is desired to be in a range of $1\times10^6$-$1\times10^{10}$ [Ω·cm] in volume resistivity. If the carrier is no more than $1\times10^6$ [Ω·cm] in volume resistivity, the electrical field between the carrier particle and peripheral surface of the photosensitive drum 3 becomes strong enough to cause electrical discharge between the carrier particle and photosensitive drum 3. That is, if the carrier is no more than $1\times10^6$ [Ω·cm] in volume resistivity, the peripheral surface of the photosensitive drum 3 is likely to end up with traces of electrical discharge. On the other hand, if the carrier is no less than $1\times10^{10}$ [Ω·cm] in volume resistivity, it becomes difficult for the counter charge of toner to attenuate. Therefore, it becomes easier for the carrier to become positively charged. Therefore, the image forming apparatus 100 is likely to output an image having carrier across its background areas.

As for the strength of magnetization of the carrier in the developing device 20, it is desired to be in a range of 50 [$Am^2$/kg]-70 [$Am^2$/kg]. If it is no more than 50 [$Am^2$/kg], the force which keeps the carrier adhered to the development rollers 21 and 31 is weaker, and therefore, the amount by which the carrier is adhered to the photosensitive drum 3 is larger. On the other hand, if it is no less than 70 [$Am^2$/kg], the carrier is higher in the efficiency which it carries the toner, which in turn increase the amount of mechanical force to which the toner is subjected. Thus, it is likely for the toner to be deteriorated at an accelerated rate.

<Outline of Experiment>

Figure 4:
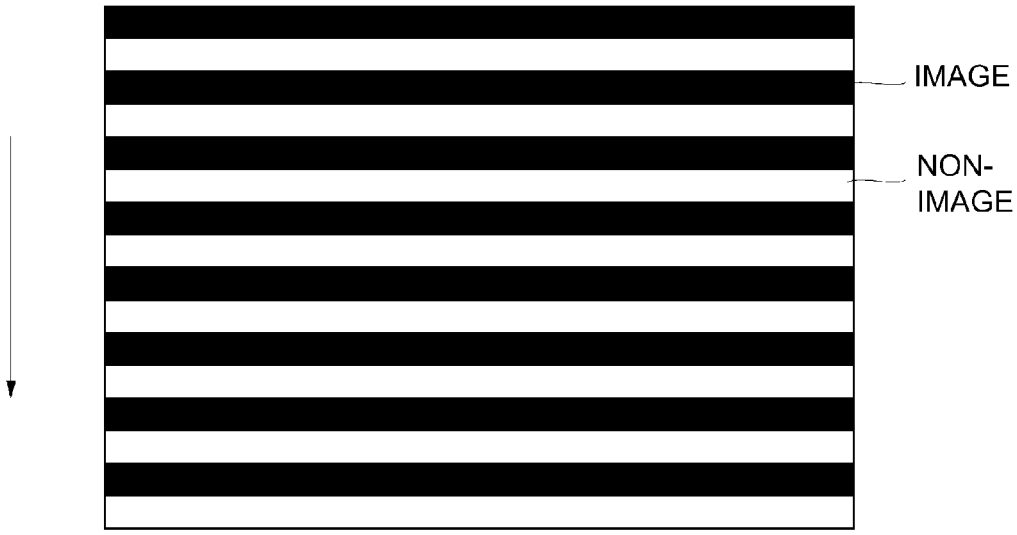
FIG. 4 is a drawing of an image to be formed to evaluate the developing device (image forming apparatus) in terms of the "background fogging", and the performance.

FIG. 4 is a drawing of a test image used in an experiment for evaluating the developing device 20 in performance, and the development performance. In the experiment, an image forming apparatus which has a photosensitive drum, the photosensitive layer of which is formed of amorphous silicon, and a developing device which has two development rollers, was used to continuously form, by a substantial number, the image shown in FIG. 4 with the use of such carrier that is lower in volume resistivity than the conventional carrier, at a process speed which is no less than 500 mm/sec. Then, based on the result of the experiment, the condition under which a developing device is to be operated in order to make it difficult for the developing device to yield an image having foggy background areas, while keeping the developing performance was sought. The image forming apparatus used in the experiment is an improved version of a copy machine Image Process C7000 VP (trade mark) (product of Canon Co., Ltd.).

The test image, shown in FIG. 4, which is 50% in duty ratio and highest in image density (solid image) was continuously outputted (copied), by a substantial number, using A4 size sheets of ordinary paper. Then, every n-th (n being preset number) of copy was evaluated for the developing performance.

TABLE 1

| | Comp. Ex. 1 | Comp. Ex. 2 | Comp. Ex. 3 | Comp. Ex 4 | Emb. 1 | Emb. 2 | Embs 3 & 4 |
|---|---|---|---|---|---|---|---|
| Number of rollers | 1 | 2 | 2 | 2 | 2 | 2 | 2 |
| Ups. roller:Speed ratio | 1.6 | 1.6 | 1.2 | 1.6 | 1.6 | Variable | 1.6 |
| Dws. roller Speed ratio | — | 1.6 | 1.2 | 1.6 | 1.2 | Variable | Variable |
| Other | | | | Only carrier | | Vt > Vr | Adjusting mode |
| Developing property | N | G | F | Non-evaluatable | G | G | G |
| Fog | G | N | G | Non-evaluatable | G | G | G |

G: Good,
F: Fair,
N: No good

Referring to Table 1, the first comparative developing device was provided with only a single development roller, the peripheral velocity ratio of which relative to the photosensitive drum was 1.6. The volume resistivity of photosensitive layer of the s-Si photosensitive member was no less than $1\times10^{9}$ [Ω·cm] and no more than $1\times10^{14}$ [Ω·cm]. That is, it is higher than the volume resistivity of a conventional photosensitive member having a photosensitive layer made of OPC. Therefore, it is easier for electrical charge to be injected into the a-Si photosensitive drum from the carrier during development. As electrical charge is injected into the photosensitive layer of the a-Si photosensitive drum from the carrier, the amount of difference (fog prevention contrast) between the development roller, and the second area of the electrostatic image on the photosensitive drum, that is, the area to which toner is not to adhere, reduces, and therefore, the developing device tends to adhere toner to the second area of the electrostatic image (image forming apparatus tends of yield an image having foggy background areas). However, as the image forming apparatus is increased in process speed, and therefore, the photosensitive drum rotates at a higher speed, the length of time electrical charge is injected into the photosensitive layer of the photosensitive drum reduces. Consequently, the actual amount by which electrical charge is injected into the photosensitive layer of the photosensitive drum reduces. It is thought that as long as the process speed is no less than 500 mm/sec, even if such carrier that is no less than $1\times10^{6}$ [Ω·cm] and no more than $1\times10^{10}$ [Ω·cm] in volume resistivity is used, the amount by which electrical charge is injected remains below the tolerable level. Therefore, the first comparative developing device 1 enables the image forming apparatus 100 to continue to output images which are not foggy across their background areas for a long time, provided that the process speed is kept higher than 500 mm/sec.

Referring again to Table 1, the second comparative developing device 2 is provided with two development rollers, and the ratio of the peripheral velocity of each of the development rollers relative to that of the photosensitive drum was 1.6. It was superior in performance to the first comparative developing device 1, as long as the photosensitive drum of amorphous silicon (a-Si) was used, and the process speed was kept higher than 500 mm/sec. However, the second comparative developing device 2 was substantial in the number of images having foggy background areas, when the images were formed at a process speed of no less than 500 mm/sec.

Referring again to Table 1, the third comparative developing device 3 was the same in structure as the second comparative developing device 2, but the ratio of the peripheral velocity of their development roller relative to the peripheral velocity of the photosensitive drum was 1.2. The third comparative developing device 3 was less in the peripheral velocity ratio of its development rollers relative to the photosensitive drum than the second comparative developing device 2, and was extremely lower in the developing performance than the second comparative developing device 2. However, the third comparative developing device 3 did not suffer from the problem which the second comparative developing device 2 suffered; it did not output images having foggy background areas.

Referring again to Table 1, the fourth comparative developing device 4 is the same in structure as the second comparative developing device 2, but "developer" made up of only carrier (100% carrier) was used to rub the peripheral surface of the photosensitive drum with a magnetic brush formed of only carrier. The fourth comparative developing device 4 confirmed that rubbing the peripheral surface of the photosensitive drum with the magnetic brush which is substantially low in the friction between itself and the peripheral surface of the photosensitive drum because of the loss of toner from the developer in the developing device increases the amount by which electrical charge is injected into the photosensitive drum from the magnetic brush.

Referring to Table 1, the developing device 20 in the first embodiment of the present invention is the same in structure as the second comparative developing device 2, but the ratio of the peripheral velocity of the first development roller relative to the peripheral velocity of the photosensitive drum was 1.6, and the ratio of the peripheral velocity of the second development roller relative to that of the photosensitive drum was 1.2. The developing device 20 in the first embodiment, the peripheral velocity ratio of the downstream development roller of which relative to the photosensitive drum was less than the of the upstream development roller, remained excellent in performance in terms of the development performance, and did not cause the image forming apparatus to output an image having foggy background areas 2.

Referring to Table 1, the developing device 20 in the second embodiment was practically the same as that in the first embodiment, except that the downstream development roller of the developing device 20 in the second embodiment was variable in peripheral velocity so that the downstream development roller could be kept as high as possible in peripheral velocity within a range in which an image having foggy background areas is not outputted. Therefore, not only did the developing device in the second embodiment output image having no problematic foggy background areas, but also, was higher in the development performance than the developing device 20 in the first embodiment.

Referring to Table 1, the developing devices in the third and fourth embodiments are practically the same in structure and operation as that in the second embodiment, except that the peripheral velocity of their development rollers are set in the adjustment mode in which the image forming apparatus is operated during an image formation interval to form an electrostatic test image for obtaining proper values for the parameters of the image formation settings. Thus, the developing devices in the third and fourth embodiments did not cause the image forming apparatus to output an image having foggy background areas, and were higher in the development performance than the developing device in the first embodiment.

<Common Operational Settings>

The first to fourth comparative image forming apparatuses (developing devices) and the image forming apparatus in the first to fourth embodiments are the same in following operational settings:

process speed (peripheral velocity of photosensitive drum): 300-700 [mm/sec]

closest distance x between photosensitive drum and development roller: 300 [μm]

potential level VL of exposed area of electrostatic image, which faces downstream development roller: −130 [V]

potential level VL of unexposed area of electrostatic image, which faces downstream development roller: −480 [V]

frequency of AC component of oscillating voltage (development bias): 1.5 [kHz]

peak-to-peak voltage Vpp of AC component of oscillating voltage (development bias: 1.6 [kV]

voltage Vdc of DC component of oscillating voltage (development bias): −330 [V]

fog prevention contrast ΔVs (before rubbing): 200 [V]

initial T/D ratio of developer: 10 [%]

developer amount: 500 [g].

<Coating Ratio>

In the comparative developing devices 1-3 and the developing device in the first embodiment, the toner ratio in weight (which hereafter will be referred to as T/D ratio) in two-component developer was 10%. The actually measured value of the average amount of toner charge (which hereafter will be referred to as Q/M) was −60 [μC/g].

The average amount of toner charge (Q/M) is very closely related to the toner ratio in weight (T/D ratio) in the developer. That is, the smaller the TD ratio, the greater the frequency with which toner particles and carrier particles rub against each other, and therefore, the larger the Q/M. Further, the greater the TD ratio, the smaller the frequency with which toner particles and carrier particles rub against each other, and therefore, the smaller the Q/M. However, it is not the T/D ratio alone that affects the average amount Q/M of toner charge. For example, the particles diameter and specific gravity of the carrier also substantially affect the average amount of toner charge (Q/M). Therefore, the T/D ratio alone is insufficient to estimate the frequency with which toner particles and carrier particles rub against each other. In the experiment, therefore, the coating ratio obtained by the following mathematical formula 1 was used as the parameter which indicates the ratio of toner which covers the carrier. In the formula, "$p_c$" stands for the true density of carrier; "$r_c$", carrier particle diameter; "x", TD ratio; "$p_t$", true density of toner; and "$r_t$" stands for toner particle diameter.

$$\text{Coating ratio } (\%) = \frac{\rho_c r_c x}{4\rho_t r_t (100 - x)} \times 100 \quad (1)$$

(1) TD ratio x: roughly 3 g of the developer was collected from the peripheral surface of the development roller, and was mixed into water solution of surfactant. Then, toner and carrier were separately collected from the mixture, and weighed to obtain the TD ratio.

(2) True density $\rho_t$ of carrier: it was measured with the use of an automatic densimeter of dry type (Accupic 1330: product of Shimazu Co., Ltd.). The true densities pt of the toner and carrier used by the developing device in the embodiments of the present invention were 1 g/cm$^3$ and 4 g/cm$^3$, respectively.

(3) Carrier particle diameter $r_c$: volume average particle diameter of the carrier was measured with the use of a particle size distribution meter (Microtrack MT3300EX: product of Nikki Co., Ltd.). The carrier used by the developing device in this embodiment was 40 μm in particle diameter.

(4) Toner particle diameter $r_t$: it was obtained by measuring the weight average particle diameter of the toner, with the use of a precision particle size distribution meter (Beckman-Coulter Co., Ltd.). The particle diameter $r_t$ of the toner used by the developing device in the embodiments of the present invention was 6 μm.

By evaluating the coating ratio defined above, the state of toner in terms of electrical charge can be accurately estimated without being influenced by the particle diameter and specific gravity of the carrier (by equalizing toner particles in terms of frequency with which they rub against carrier). The experiment carried out by the inventors of the present invention indicates that when the coating ratio is not less than 90%, the developer increases in the ratio of insufficiently charged toner, increasing thereby the probability with which an image having foggy background areas is formed. On the other hand, when the coating ratio falls below 20%, the toner excessively increases in the average amount of electrical charge (Q/M), increasing thereby the amount of electrostatic adhesion between the toner and carrier, which works against the transfer of toner from the developer (magnetic brush) onto the exposed portion of the electrostatic image on the peripheral surface of the photosensitive drum. That is, the developing device reduces in the development performance. Thus, the coating ratio is desired to be no more than 90%, and the bottom limit, that is, the lowest level to which the toner in the developer is allowed to be consumed, is 20%.

In the following experiments, the image shown in FIG. 4 was continuously formed without replenishing the developing device with toner, in order to gradually reduce the developer in the device in the coating ratio from roughly 70% to roughly 20%, which is quite sever from the standpoint of developing an electrostatic image. At the beginning of the operation, the TD ratio was 10%.

<Method for Evaluating Image in Terms of Foggy Background>

As a substantial number of images are continuously formed, the developer in the developing device begins to gradually reduce in electrical resistance due to the continuous toner consumption. Eventually, electrical charge begins to be injected into the photosensitive layer of the photosensitive drum through the magnetic carrier in the development areas. As the charge injection occurs, the potential (voltage) of the unexposed portions of the electrostatic image on the photosensitive member begins to converge to the voltage (potential) level of the DC component of the oscillating voltage which is being applied to the development roller. Consequently, the amount of difference between the potential (voltage) of the unexposed portion of the electrostatic image (peripheral surface of photosensitive drum) and development roller reduces, which in turn results in the formation of an image having foggy background areas. The outputted images were evaluated for the foggy background area, for every preset number of images. More specifically, the reflection density Dr of the background area of the image on a sheet of transfer paper was measured with a reflection densimeter SERISE 1200 (product of Macbeth Co., Ltd.), along with the reflection density Ds of the transfer paper itself. The highest level (255/255) of the density gradation was set as 1.2, and the density of the foggy area was evaluated based on the definition given below. Then, the images were evaluated in terms of the fogginess of their background area:

$$\text{Foggy area density}(\%)=100\times(Dr-Ds)/(1.2-Ds).$$

(1) No more than 0.5% in foggy area density: excellent (A in term of being free of fogginess), (2) in a range 0.6-2.0%: tolerable (B in terms of being free of fogginess), (3) no less than 2.1%: no good (c) in terms of being free of fogginess).

<Method for Evaluating Development Performance>

Figure 5:
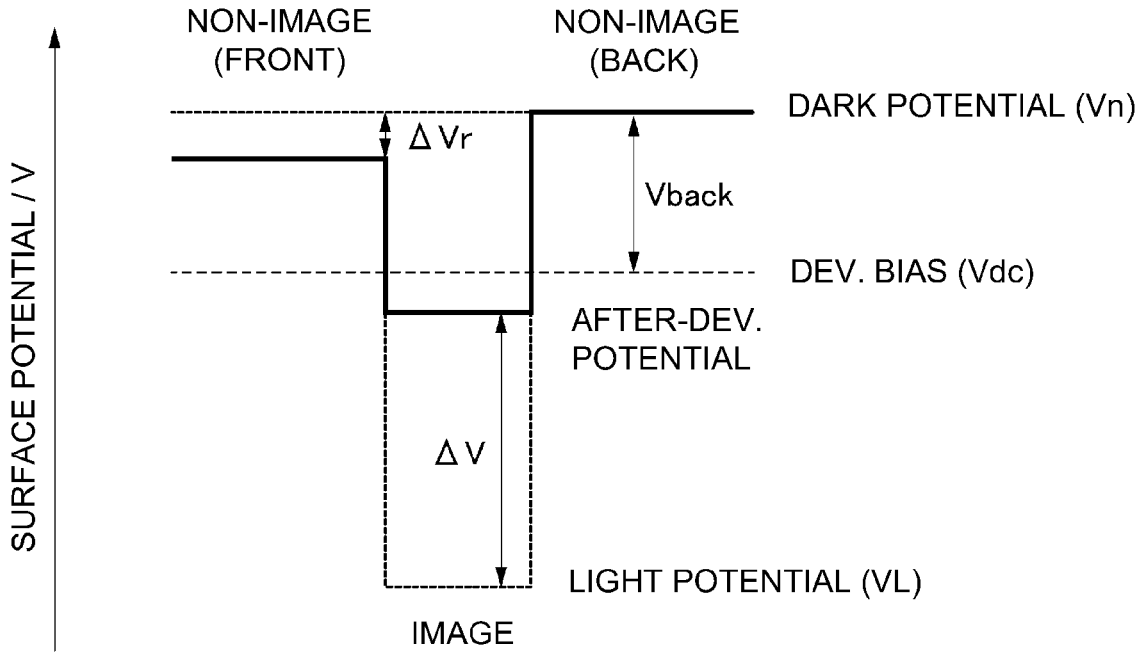
FIG. 5 is a drawing illustrating the development property an electrostatic image.
Figure 6:
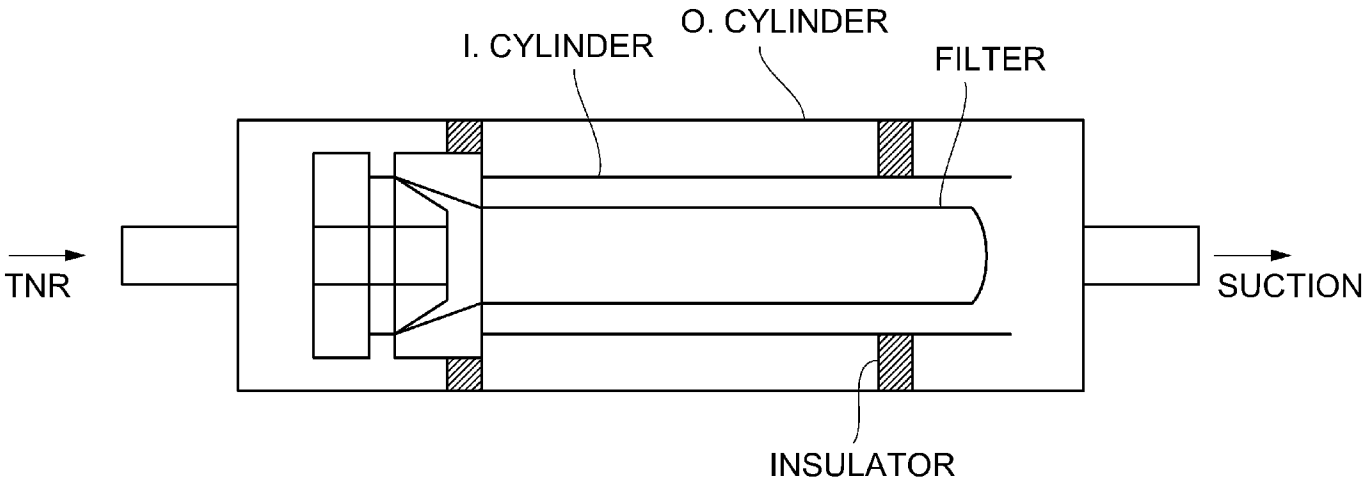
FIG. 6 is a schematic drawing of the apparatus for measuring the average amount Q/M of toner charge.

FIG. 5 is a drawing for describing the principle based on which an electrostatic image is developed. FIG. 6 is a schematic sectional view of a device for measuring the average amount (Q/M) of toner charge. The efficiency with which an electrostatic image is developed by toner can be indicated by the amount (Q/S) of toner charge per unit area of the peripheral surface of the photosensitive drum.

Referring to FIG. 5 along with FIG. 2, the process of developing an electrostatic image with the use of toner may be said to be a process of cancelling the electrical charge of the exposed area of the peripheral surface of the photosensitive drum, with toner charge, by transferring toner from the development roller onto the exposed area of the peripheral surface of the photosensitive drum by the electrical field formed by the potential (voltage) of the exposed area and the development bias. Theoretically, the potential (voltage) ΔV attributable to toner charge can be expressed by the following Mathematical Formula 2. The first item in Formula 2 represents the potential (voltage) ΔVt generated in the adjacencies of a toner layer by the toner layer itself, and the second item represents the potential (voltage) ΔVc generated between the toner layer and the substrate layer of the photosensitive member (which forms virtual capacitor).

$$\Delta V = \Delta V_t + \Delta V_c = \frac{d_t}{2\varepsilon_0\varepsilon_t}\left(\frac{Q}{S}\right) + \frac{d_m}{\varepsilon_0\varepsilon_m}\left(\frac{Q}{S}\right) \quad (2)$$

In Formula 2, $d_t$ stands for thickness of toner layer; $d_m$, thickness of photosensitive member (thickness of combination of layers on substrate); Q/S, amount of toner charge per unit area; $\in_0$, vacuum dielectric constant; $\in_t$, dielectric constant of toner layer; and $\in_m$ stands for dielectric constant of photosensitive member.

(1) Film thickness $d_m$ of photosensitive member: it was measured by a film thickness gauge of eddy current type FISCHERSCOPE MMS (product of Fischer Instrument Co., Ltd.). The film thickness $d_m$ of the photosensitive member used in the experiment was 30 μm.

(2) Dielectric constant $\in_m$ of photosensitive member: a plate coated with photosensitive substance was prepared, and the electric current which flowed through the plate when DC voltage was applied was monitored. Then, the obtained amount of electrical current was integrated with respect to elapsed time to obtain the amount q of electrical charge accumulated in the photosensitive layer. Then, the amount C of electrostatic capacity of the photosensitive plate was obtained from the relationship between the amount q of electrical charge and the applied voltage V. Then, C/S is obtained based on the area size of the electrode. Then, the dielectric constant $\in_m$ was obtained by substituting C/S in the following Mathematical Formula 3 with the obtained value of C/S. The dielectric constant $\in_m$ of the photosensitive member used in the experiment was 10.

$$\Delta V_s = V_L - V_{dc} \quad (3)$$

(3) Thickness of toner layer dt: it was measured with the use of Super High Resolution Color 3D Shape Measurement Microscope VK9500 (product of Keyence Co., Ltd.).

(4) Dielectric constant at of toner layer: it was obtained by measuring the toner layer which was roughly 1 mm in thickness, and placed between a pair of electrodes which are roughly 2.3 $cm^2$ in size, with the use of LCR meter AG-4304 (product of Ando Electric Co., Ltd.). The dielectric constant ∈t of the toner used in the experiment was 2.5.

(5) Amount (Q/S) of toner charge per unit area: Referring to FIG. 6, a Faraday gauge has a double-walled cylinder made up of two metallic cylinder which are different in diameter and are coaxially positioned, and a filter for allowing only toner to enter the inward cylinder. The inner and outer cylinder are electrically insulated from each other. Therefore, as the toner on the photosensitive member is sucked into the filter by vacuum, static electricity is induced by the electrical charge Q of the toner. The amount of this induced static electricity was measured by an electrometer KEITHLEY 601. Then, the obtained amount of static electricity was divided by the weight M of the toner in the inner cylinder to obtain the average amount Q/M (X/g) of the toner charge. Further, the area of the photosensitive member, from which the toner was suctioned away, was measured in size, and the amount M of the toner was divided by the area size to obtain M/S ($mg/cm^2$). Lastly, Q/S was obtained by multiplying Q/M by M/S.

Referring to FIG. 5 along with FIG. 2, in the case that the development performance is sufficiently high, an electrostatic image continues to be developer by toner until ΔV becomes equal to ΔVs. Here, ΔVs can be expressed in the form of the following Mathematical Formula 4, using the potential level VL of the exposed portion of the electrostatic image on the peripheral surface of the photosensitive drum and the voltage Vdc of the DC component of the development bias:

$$\text{Charging ratio } (\%) = \frac{\Delta V}{\Delta V_s} \times 100 = \left( \frac{\frac{d_t}{2\varepsilon_0\varepsilon_t}\left(\frac{Q}{S}\right)}{\Delta V_s} + \frac{\frac{d_m}{\varepsilon_0\varepsilon_m}\left(\frac{Q}{S}\right)}{\Delta V_s} \right) \times 100 \quad (4)$$

On the other hand, when the development performance is low, an electrostatic image fails to be completely developed by toner, ΔV remaining smaller than Δvs (ΔV<ΔVs). That is, in order to numerically indicates the development property or performance, that is, the extent to which the latent image is covered by the toner charge, a charging rate (ratio) expressible by Mathematical Formula 4 was introduced.

$$\varepsilon_m = \frac{C}{S} \times \frac{d_m}{\varepsilon_0}. \quad (5)$$

If the development contrast Vs cannot be fully cancelled by the toner charge, an image which is nonuniform in the amount of toner per unit area of the exposed portion of an electrostatic image is outputted. More specifically, an electrostatic image is developed in such a manner that the portion of the exposed portion of the electrostatic image, which was exposed before the occurrence of an external disturbance, for example, fluctuation of the peak-to-peak voltage Vpp of the development bias, becomes different in the amount of toner per unit area from the portion of the exposed portion of the electrostatic image which was exposed after the occurrence of the external disturbance. In other words, the developing device becomes unstable in image density. According to the studies made by the inventors of the present invention, from the standpoint of keeping a developing device stable in image density at a tolerable level or higher, the charge ratio needs to be no less than 90%. Thus, the charging ratio was obtained by substituting the Q/S with the value obtained by the measuring method which will be described next. Then, the performance of the developing device was evaluated with reference to the following standard:

(1) 100% in charging ratio: excellent (A in the development performance)

(2) 90%-99% in charging ratio: tolerable (B in the development performance)

(3) No more than 89% in charging ratio: intolerable (C in the development performance)<

<Method for Measuring Volume Resistivity of Carrier>

Figure 7:
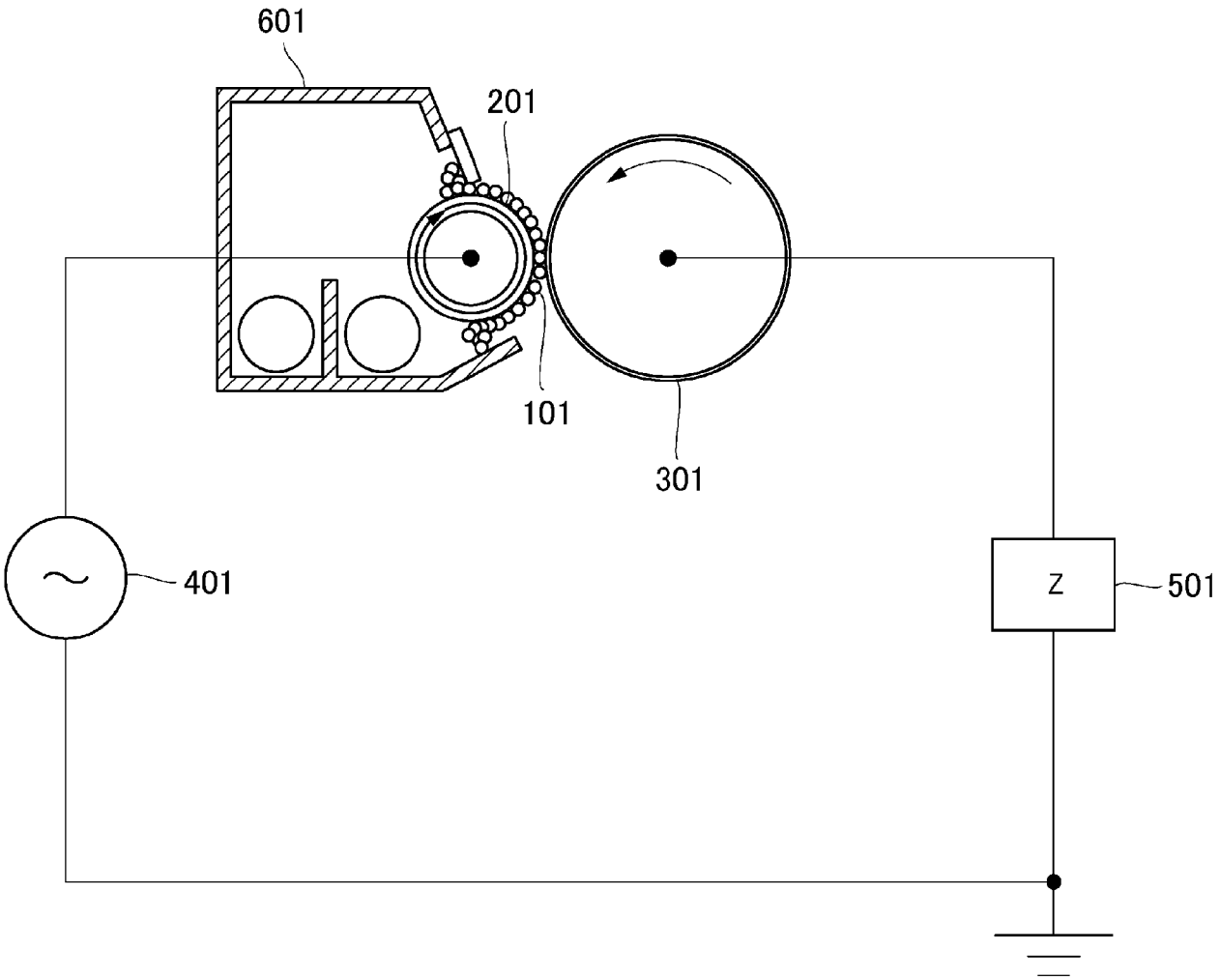
FIG. 7 is a schematic drawing of the apparatus for measuring the volume resistivity of carrier.

FIG. 7 is a schematic drawing of an apparatus for measuring the volume resistivity of carrier. Referring to FIG. 7, the apparatus is made up of an aluminum drum 301 (cylindrical member), which is rotatable at a preset speed, an electrical power source 401 HVA4321 (product of NF Co., Ltd.), and a dielectric member measuring system 126096W (product of Solartron Co., Ltd.). A developing device 601 is filled with carrier 101 alone. The drum 301 is positioned next to the development roller 201 of the developing device 601 so that the shortest distance (which hereafter will be referred to as SD gap) between itself and peripheral surface of the photosensitive drum 301 becomes the same as the SD gap between the development roller and photosensitive drum in an actual developing device. The impedance between the drum 301 and development roller 201 was obtained by measuring the amount of electric current flowed by the AC voltage (having sinusoidal waveform) applied between the drum 301 and development roller 201 from the power source 401, while being varied in frequency, while the drum 301 and development roller 201 were rotated at preset peripheral velocities. The peak-to-peak voltage of the AC voltage having the sinusoidal waveform was set so that it was $2\times10^4$ V/cm in SC gap.

In the experiment, the amount of the current flowed by the AC voltage was measured with the use of a dielectric member measuring system 505 (126096W: product of Solartron Co., Ltd.), while the AC voltage was varied in frequency from 1 Hz to 10 kHz. Then, the current values (true and imaginary actual and false portions) obtained at various frequencies were plotted (cole-cole plotting). Then, an equivalent circuit (parallel circuit made of RC) was obtained with the use of an analysis software (Zview: product of Solartron Co., Ltd.). Then, the electrical resistance component and electrostatic capacity of the carrier were obtained. Lastly, the volume resistivity (Ω·cm) of the carrier was obtained from the electrical resistance value of the carrier and the carrier volume (size of area of contact x SC gap).

<Amount of Magnetization of Carrier>

The amount of the magnetization of carrier in a magnetic field which is 1000/4Π [kA/m] was no less than 50 [$Am^2$/kg] and no more than 70 [$Am^2$/kg]. An external magnetic field which is 1000/4Π [kA/m] in strength was created with the use of a VSM magnetometer (BHV-35: product of Riken Electric Co., Ltd.), and the magnetic carrier packed in a cylindrical plastic container was placed in the magnetic field to measure the magnetic moment. Then, the strength ($Am^2$/kg) of the magnetization of the carrier was obtained from the weight of the test sample.

<Comparative Developing Device 1>

Figure 8:
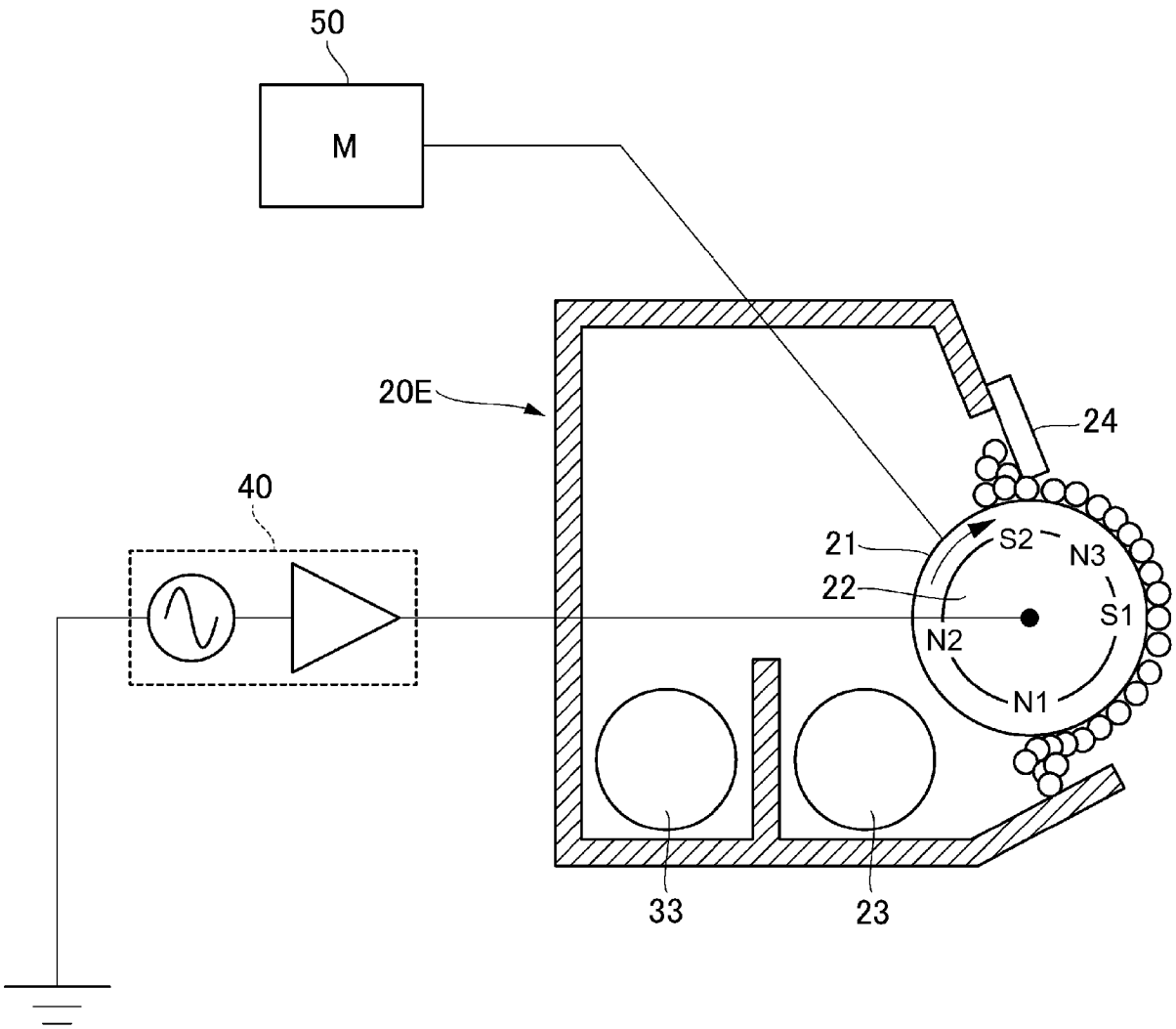
FIG. 8 is a schematic sectional view of a developing device which uses a single development roller, and shows the general structure of the device.

FIG. 8 is a schematic sectional view of the first comparative developing device 1 which uses a single development roller. It shows the general structure of the device. Referring to FIG. 8, the first comparative developing device 1 uses only one development roller. The ratio of the peripheral velocity of its development roller relative to that of the photosensitive drum is 1.6. This developing device was used to continuously form 280 images at process speeds of 300, 500 and 700 mm/sec, while measuring the TD ratio, and coating ratio, after the formation of 40th, 80th, 120th, 160th, 200th, 240th and 280th images. The results are shown in Table 2.

TABLE 2

| | No. of Images | | | | | | |
|---|---|---|---|---|---|---|---|
| | 40 | 80 | 120 | 160 | 200 | 240 | 280 |
| TD ratio (%) | 9 | 8 | 7 | 6 | 5 | 4 | 3 |
| Coating ratio (%) | 69 | 60 | 51 | 43 | 36 | 29 | 22 |

The relationship among the evaluation of the images in terms of the foggy background, and the development performance, process speed, and cumulative number of images made are shown in Table 3.

TABLE 3

| | No. of Images | | | | | | |
|---|---|---|---|---|---|---|---|
| | 40 | 80 | 120 | 160 | 200 | 240 | 280 |
| 300 mm/sec | A/B | A/B | B/B | B/B | B/C | C/C | C/C |
| 500 mm/sec | A/B | A/B | A/B | B/C | B/C | B/C | B/C |
| 700 mm/sec | A/B | A/B | A/C | A/C | B/C | B/C | B/C |

Each of the cells of Table 3 (excluding cells in top row and leftmost column) shows the results of evaluation of the images in terms of the fogginess and the development performance. The first comparative developing device 1 had only one development roller. Thus, the amount by which it supplied the photosensitive drum with toner was insufficient to deal with the increase in the process speed. That is, it failed to remain above a tolerable level in terms of developmental performance before the coating ratio fell to roughly 20% (280th image), that is, the target level. Concerning the foggy background, it remained above the tolerable level until the coating ratio fell to roughly 20% (280th image), that is, the target level, when the process speed was kept at 500 mm/s and 700 mm/s. However, it began to develop an electrostatic image into an image having foggy background at 240th sheet.

It is thought that the reason why process speed is closely related to the outputting of an image having foggy background is that the increase in the process speed reduces the length of time a give portion of the peripheral surface of the photosensitive drum is in the development area, and therefore, it reduces the length of time electrical charge is injected into a given portion of the peripheral surface of the photosensitive drum. More specifically, the dimension of the development area in terms of the moving direction of the peripheral surface of the photosensitive drum is roughly 4 mm. Thus, the length of time a given portion of the peripheral surface of the photosensitive drum is exposed to the development area when the process speed is 300 mm/sec is 13 ms, whereas when the process speed is 700 mm/sec, it is 5.7 ms.

Thus, it is impossible for the developing device having only one development roller to continue to develop an electrostatic image into a toner image (visible image) which does not have foggy ground and is excellent in the developing performance, for a long time (until coating ratio falls to roughly 20%).

<Comparative Developing Device 2>

Referring to FIG. 2, the second comparative developing device 2 is provided with two development rollers, the peripheral velocity of which are set so that the ratio of their peripheral velocity relative to that of the photosensitive drum becomes 1.6. This developing device was tested in an experiment in which the image forming apparatus was operated at process speeds of 300, 500 and 700 mm/sec to output 220 images. Then, the 20th, 60th, 100th, 140th, 180th and 220th images were measured in TD ratio and coating ratio. The results of the measurement are given in Table 4.

TABLE 4

| | No. of Images | | | | | |
|---|---|---|---|---|---|---|
| | 20 | 60 | 100 | 140 | 180 | 220 |
| TD ratio (%) | 10 | 8 | 7 | 6 | 4 | 3 |
| Coating ratio (%) | 74 | 61 | 49 | 39 | 29 | 20 |

Further, the 20th, 60th, 100th, 140th, 180th and 220th images, which were outputted when the process speed was 300, 500 and 700 mm/sec, were evaluated in terms of foggy background and the development performance. The results of the evaluation are given in Table 5.

TABLE 5

| | No. of Images | | | | | |
|---|---|---|---|---|---|---|
| | 20 | 60 | 100 | 140 | 180 | 220 |
| 300 mm/sec | B/A | C/A | C/A | C/A | C/A | C/A |
| 500 mm/sec | B/A | B/A | C/A | C/A | C/A | C/A |
| 700 mm/sec | B/A | B/A | B/A | C/A | C/A | C/A |

The cells in Table 5 (except for cells in top row and leftmost column) show the evaluation of the images in terms of foggy background and the development performance. The second comparative developing device 2 failed to continue to output images which are above the tolerable level in terms of foggy background, before the coating ratio fell below roughly 20% (before 220th image was outputted). The study about the location of the foggy background areas revealed that the background was made foggy mainly by the downstream development roller.

Based on this discovery, it seems to be reasonable to think that the mechanism of the fogging of the background is as follows: In the case of a developing device having two development rollers, the downstream roller bears the developer, from which toner was consumed by a substantial amount when it was borne by the upstream development roller. Therefore, the developer on the downstream development roller is lower in electrical resistance. Therefore, as the developer in the developing device reduces in the amount of toner because of continuous formation of a substantial number of toner images, the developer on the downstream development roller becomes extremely low in electrical resistance, and therefore, is likely to inject electrical charge into the photosensitive layer of the photosensitive drum by a greater amount. As electrical charge is injected into the photosensitive layer of the photosensitive drum, the potential level of the unexposed portion of the electrostatic image converges to the potential level of the DC component of the voltage being applied to the development roller, reducing thereby the amount of difference in potential level between the unexposed portion of the electrostatic image and the development roller. As a result, an image having foggy background is outputted.

That is, in the case of the second comparative developing device 2, the developer on the downstream development roller is "carrier rich" developer, that is, the developer from which toner was supplied to the photosensitive drum when it was on the upstream development roller. Thus, the developer between the downstream development roller and the photosensitive drum is lower in electrical resistance than the developer between the upstream development roller and the photosensitive drum. Therefore, the amount by which electrical charge is injected into the photosensitive layer of the photosensitive drum by the downstream development roller is greater than that by the upstream development roller.

As a substantial number of images are continuously formed, the developer in the developing device reduces in the amount of toner. Thus, it reduces in electrical resistance. For the reason given above, the developer on the downstream development roller is smaller in electrical resistance than that on the upstream development roller. Therefore, the potential of the unexposed portion of the peripheral surface of the photosensitive drum converges to the potential of the DC component of the voltage being applied to the development roller, reducing thereby the fog prevention contrast (Vback), which is the difference in potential level between the unexposed portion of the electrostatic image on the photosensitive drum and the potential level of the development roller. Consequently, it becomes likely for toner to be adhered to the unexposed portion of the electrostatic image (background); it becomes likely for the developing device to develop the electrostatic image into a toner image having foggy background.

Concerning the development performance, it was kept above the tolerable level regardless of process speed, until the coating ratio fell to roughly 20% (until 220th image is formed), or the target ratio. It seems to be reasonable to think that this result is attributable to the fact that the developing device was provided with two development rollers, being therefore substantially greater in the frequency (length of time) with which the photosensitive drum is placed in contact with the developer (magnetic brush), and the length of time the development bias is applied to the development roller, than the first comparative developing device which has only one development roller.

<Comparative Developing Device 3>

Referring to FIG. 2, the second comparative developing device 2 is provided with two development rollers, which are set in peripheral velocity so that the ratio of their peripheral velocity relative to that of the photosensitive drum becomes 1.6. This developing device was tested in an experiment in which the image forming apparatus was operated at process speeds of 300, 500 and 700 mm/sec to output 220 images. Then, the developer in the developing device was measured in TD ratio and coating ratio, after the 20th, 60th, 100th, 140th, 180th and 220th images were outputted. The results of the measurement are given in Table 6.

TABLE 6

| | No. of Images | | | | | |
|---|---|---|---|---|---|---|
| | 40 | 80 | 120 | 160 | 200 | 240 |
| TD ratio (%) | 9 | 8 | 7 | 5 | 4 | 3 |
| Coating ratio (%) | 68 | 57 | 47 | 38 | 30 | 22 |

Further, the 20th, 60th, 100th, 140th, 180th and 220th images, which were outputted when the process speed was 300, 500 and 700 mm/sec, were evaluated in terms of foggy background and the development performance. The results of the evaluation are given in Table 7.

TABLE 7

| | No. of Images | | | | | |
|---|---|---|---|---|---|---|
| | 40 | 80 | 120 | 160 | 200 | 240 |
| 300 mm/sec | A/B | A/B | A/B | B/C | B/C | B/C |
| 500 mm/sec | A/B | A/B | A/C | A/C | B/C | B/C |
| 700 mm/sec | A/B | A/C | A/C | A/C | A/C | B/C |

The cells in Table 5 (except for cells in top row and leftmost column) show the evaluation of the images in terms of foggy background and the development performance. The second comparative developing device 2 successfully continued to output images which are above the tolerable level in terms of foggy background, regardless of process speed, that is, whether it was 300, 500 or 700 mm/sec, until the coating ratio fell below roughly 20% (until 240th image was outputted).

The reason why reduction in process speed improves a developing device in terms of the foggy background seems to be as follows. Reduction in process speed reduces a developing device in the number of magnetic brush which contributes to injection of electrical charged into the photosensitive layer of the photosensitive drum, by coming into contact with the photosensitive drum. Therefore, the developing device is reduced in the amount by which it injects electrical charge into the photosensitive layer of the photosensitive drum.

As for the developing performance, the second comparative developing device failed to remain above the tolerable level until the coating ratio fell to roughly 20% (target ratio) (240th image). It is reasonable to think that the reason for this failure is attributable to the fact that reduction in the ratio in terms of peripheral velocity between a development roller and a photosensitive drum reduces the frequency (length of time) with which the photosensitive drum comes into contact with the developer (magnetic brush) on the development roller, and the length of time development bias is applied.

Based on the experiment described above, it became evident that a developing device which has two development rollers, or the upstream and downstream rollers, which are the same in peripheral velocity ratio relative to a photosensitive member, cannot continue to be above the tolerable level in terms of both the foggy background and the development performance.

<Comparative Developing Device 4>

Figure 9:
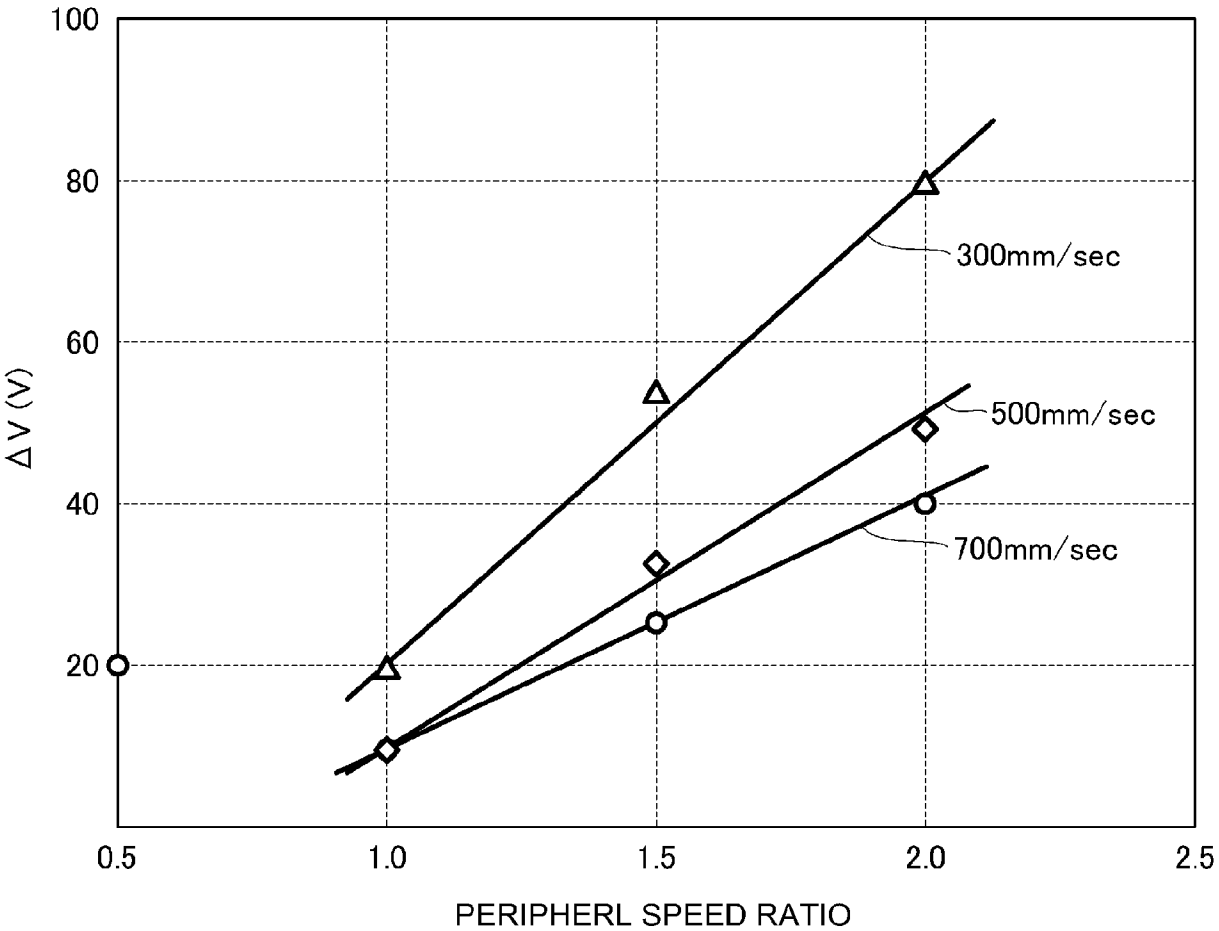
FIG. 9 is a graph which shows the relationship between the ratio in peripheral velocity between the development roller and photosensitive member, and the measured amount by which the electrical charged was injected into the photosensitive member through the development roller in the fourth comparative developing device.

FIG. 9 is a graph which shows the relationship between the amount of injection of electrical charge into the photosensitive drum through the development roller of the fourth comparative developing device 4, and the ratio in peripheral velocity between the development roller and the photosensitive drum, when the process speed was 300, 500 and 700 mm/sec.

Referring to FIG. 2, the fourth comparative developing device 4 is provided with two development rollers, that is, the upstream and downstream development rollers, which can be varied in peripheral velocity as long as they are kept the same in peripheral velocity. Otherwise, it is the same as the second comparative developing device. This developing device was tested in an experiment which is the same in the condition under which the developing device was operated, as the experiment in which the second comparative developing device was tested. In this experiment, the device was tested to verify that the peripheral velocities of the a photosensitive member and development roller really affect the amount by which electrical charge is injected into the photosensitive layer of the photosensitive drum.

First, the second comparative developing device, such as the one shown in FIG. 2, was tested without placing developer in the developing device. The peripheral surface of the photosensitive drum 3 was charged to a preset potential level (Vn: potential level of unexposed portion of electrostatic image) by a charging device, and the surface potential level of the photosensitive drum 3 was measured by a potentiometer S positioned directly below the developing device.

Next, carrier alone (developer minus toner) was placed in the developing device 20. Then, the peripheral surface of the photosensitive drum 3 was charged, and development bias was applied to the development rollers. Then, the surface potential level (Vs) of the photosensitive drum 3 was measured with the use of the potentiometer placed directly below the developing device 20. The electrical charge injected into the development roller by the development bias changes the photosensitive drum 3 in surface potential level by being injected into the photosensitive layer of the photosensitive drum 3 through the magnetic brush (made up of only carrier).

The amount ΔV of electrical charge injected into the photosensitive layer of the photosensitive drum 3 can be expressed by Mathematical Formula 6.

$$\Delta V(V)=|V_n-V_S| \quad (6)$$

FIG. 9 is a graph which shows the relationship between the measured amount ΔV of electrical charge injected into the photosensitive layer of the photosensitive drum and the ratio in peripheral velocity between the development rollers and photosensitive drum 3 when the process speed was 300, 500, and 700 mm/sec. As is evident from FIG. 9, if the ratio in peripheral velocity between the development rollers and photosensitive drum is fixed, the higher the process speed, the smaller the amount ΔV by which electrical charge is injected. This result backs up the fact that the higher the process speed, the smaller the amount by which the fog prevention contrast is reduced, and therefore, the more unlikely for an image having foggy background to be formed. Further, the higher the ratio of the peripheral velocity of the development rollers relative that of the photosensitive drum, the greater the amount ΔV of the injection of electrical charge. This result backs up the fact that the smaller the ratio of the peripheral velocity of the development roller relative to the photosensitive drum, the smaller the amount by which the fog prevention contrast is reduced, and therefore, the less likely for an image having foggy background to be formed.

Embodiment 1

Referring to FIG. 1, a combination of the charging device 5 and exposing device 6, which is an example of means for forming an electrostatic image, forms an electrostatic image on the peripheral surface of the photosensitive drum 3 which is an example of photosensitive member. An electrostatic image is made up of an actual image portion, that is, the portion of the electrostatic image, to which toner is to adhere as the electrostatic image is developed, and a background portion, that is, the portion of the electrostatic image, to which toner is not to adhere when the electrostatic image is developed.

The upstream development roller 21, which is an example of the first development roller, bears developer which is a mixture of toner, and carrier which is lower in volume resistivity than the toner. As development bias, that is, a combination of DC voltage and AC voltage, is applied to the upstream development roller 21, the roller 21 develops the electrostatic image on the peripheral surface of the photosensitive drum 3. More specifically, as the development voltage is applied to the upstream development roller 21, the developer on the peripheral surface of the roller 21 is made to crest in the form of a brush (magnetic brush), which develops the electrostatic image on the photosensitive drum 3 by coming into contact with, and rubbing, the electrostatic image. As for the downstream development roller 31, which is an example of the second development roller, it bears the developer transferred thereto from the development roller 21. It develops, for the second time, the electrostatic image on the peripheral surface of the photosensitive drum 3 as development bias, that is, a combination of DC voltage and AC voltage, is applied to the downstream development roller 31. That is, as the development voltage is applied to the downstream development roller 31, the developer on the peripheral surface of the roller 31 is made to crest in the form of a brush (magnetic brush), which develops the electrostatic image on the photosensitive drum 3 by coming into contact with, and rubbing, the electrostatic image.

Motors 50 and 60, which are examples of driving means, rotate the development rollers 21 and 31, respectively, at a peripheral velocity which is higher than that of the photosensitive drum 3. Further, the motors 50 and 60 can rotate the development rollers 21 and 31 in such a manner that the development roller 31 becomes less in peripheral velocity than the development roller 21.

In the first embodiment, the developing device is provided with two development rollers, that is, the upstream and downstream rollers 21 and 31. The peripheral velocity of the upstream development roller 21 is set so that its peripheral velocity ratio relative to the photosensitive drum 3 becomes 1.6, and the peripheral velocity of the downstream development roller 31 is set so that its peripheral velocity ratio relative to the photosensitive drum 3 becomes 1.2. This developing device was used form 240 images at process speeds of 300, 500 or 700 mm/sec. During the image forming operation, the developer in the developing device was measured in the T/D ratio and coating ratio, after the formation of the 20th, 60th, 100th, 140th, 180th and 220th images. The results of the measurement are given in Table 8.

TABLE 8

| | No. of Images | | | | | |
|---|---|---|---|---|---|---|
| | 40 | 80 | 120 | 160 | 200 | 240 |
| TD ratio (%) | 9 | 8 | 6 | 5 | 4 | 3 |
| Coating ratio (%) | 68 | 56 | 46 | 37 | 27 | 20 |

These images were evaluated in terms of the presence of fog on the background, and the development performance. The results of the evaluation are given in Table 9.

TABLE 9

| | No. of Images | | | | | |
|---|---|---|---|---|---|---|
| | 40 | 80 | 120 | 160 | 200 | 240 |
| 300 mm/sec | A/A | A/A | B/A | B/A | B/B | B/B |
| 500 mm/sec | A/A | A/A | A/A | B/A | B/B | B/B |
| 700 mm/sec | A/A | A/A | A/B | A/B | B/B | B/B |

The cells in Table 9 (except for cells in top row and leftmost column) show the evaluation of the images in terms of the foggy background and the development performance. The developing device in the first embodiment successfully continued to output images which are above the tolerable level in terms of foggy background, regardless of process speed, that is, whether it was 300, 500 or 700 mm/sec, until the coating ratio fell below roughly 20% (until 240th image was outputted). The reason for the success of this developing device seems to be that setting the ratio Sr of the peripheral velocity of the downstream development roller 31 relative to that of the photosensitive drum, to 1.2 reduced the amount of the injection of the electrical charge into the photosensitive layer of the photosensitive drum, which in turn reduced the amount by which toner is adhered to the background (unexposed) portion of the electrostatic image.

In terms of the development performance, the developing device in the first embodiment remained above the tolerable level, regardless of process speed, that is, whether the process speed was 300, 500 or 700 mm/sec, until the coating ratio fell to roughly 20%, that is, the target ratio (up to 240th image). The reason why this developing device was able to remain above the tolerable level in terms of the evaluation of the development performance is as follows. That is, it is unlikely that a substantial amount of toner is transferred onto an electrostatic image from the downstream development roller, which receives developer from the upstream development roller, for the following reason.

That is, the downstream development roller receives developer from the upstream development roller. Therefore, the developer on the downstream development roller is smaller in the amount of toner than the developer on the upstream development roller, which is transferred onto the downstream development roller. Further, by the time a given portion of the electrostatic image on the photosensitive drum is developed by the developer on the downstream development roller, the exposed portion of the given portion will have been already canceled by the toner charge. Therefore, the electric field generated between the exposed portion of the electrostatic image and the downstream development roller is weaker. Therefore, even if the downstream development roller is reduced in its peripheral velocity ratio Sr relative to the photosensitive drum, it does not significantly affect the overall quality of the visible image into which the electrostatic image is going to be developed.

The first embodiment can minimize the amount by which toner is adhered to the background while being able to keep a developing device at a tolerable or higher level in terms of the developing property (overall quality of the developed electrostatic image), when the image forming apparatus with which the developing device in accordance with the present invention is used, and which employs an a-Si photosensitive member, the volume resistivity of the surface layer (photosensitive layer) of which is in a range of $1\times10^{6}$-$1\times10^{14}$ Ω·cm, is operated at a process speed of no less than 500 mm/sec. Further, not only can it minimize the amount by which toner is adhered to the background, but also, can keep a developing device having two development rollers, at a tolerable or higher level in terms of the development performance (overall quality of the developed electrostatic image), when the developing device is used with two component developer, the carrier of which is in a range of $1\times10^{6}$-$1\times10^{10}$ Ω·cm in volume resistivity. That is, the first embodiment can ensure that an electrostatic image forming apparatus, the developing device of which has two development rollers, continues to output an image which is not foggy across its background area and high in overall quality of its actual image portion, for a long time.

A photosensitive member based on amorphous silicon is higher, because of the nature of its photosensitive layer, than a conventional photosensitive member based on OPC, in the amount by which electrical charge is injected into the unexposed portion of a photosensitive member through a magnetic brush when AC voltage is applied to a development roller while the magnetic brush is in contact with the peripheral surface of the photosensitive member. Further, in the case of the developing device in this embodiment, the magnetic brush on the peripheral surface of the second development roller (downstream development roller) is formed of the developer from the first development roller (upstream development roller), that is, the developer, which is significantly lower in toner ratio, because of the toner consumption therefrom, which occurred while it was on the first development roller. Therefore, the probability with which electrical charge is injected into the photosensitive drum through the direct contact between the carrier in the magnetic brush on the second development roller and the photosensitive drum is higher than the probability with which electrical charge is injected into the photosensitive drum through the direction contact between the carrier in the magnetic brush on the first development roller and the photosensitive drum. Therefore, as the developer in the developing device reduces in toner ratio, and therefore, reduces in electrical resistance, during an image forming operation in which a substantial number of images are continuously formed, the frequency with which the magnetic carrier in the magnetic brush which is lower in electrical resistance directly rubs the photosensitive drum increases, increasing thereby the amount by which electrical charge is injected into the photosensitive drum from the magnetic brush. Consequently the unexposed portion of electrostatic image reduces in potential to a level, at or below which toner cannot be prevented from adhering to the unexposed portion. Consequently, the image forming apparatus outputs an image which is foggy across its background area.

In the first embodiment, the peripheral velocity of the first development roller was set higher to ensure that the developing device remains satisfactory in terms of the development performance, whereas the peripheral velocity of the second development roller was set lower to minimize the amount by which the unexposed portion of an electrostatic image reduces in potential, by reducing the amount of "electrical charge injection frequency x electrical charge injection amount" per unit area of the peripheral surface of a photosensitive drum. Therefore, it is assured that even when the developer in the developing device having two development rollers reduces in toner ratio while a substantial number of images are continuously formed, the developing device remains satisfactory in terms of the development performance, and is prevented from adhering toner to the unexposed portion of the electrostatic image (forming image having foggy background).

Also in the first embodiment, the first and second development rollers are set higher in peripheral velocity than the photosensitive member, and the second development roller is set lower in peripheral velocity than the first development roller, in order to minimize (prevent) the toner adhesion to the background (production of foggy background) while assuring the development performance.

The magnetic brush on the second development roller is formed of the developer which is lower in toner ratio because of the toner consumption which occurred while it was on the first development roller. Therefore, it is higher than the magnetic brush on the first development roller, in the probability with which electrical charge is injected into the photosensitive member through the direct contact between carrier and photosensitive member. In this embodiment, therefore, the peripheral velocity of the first development roller was set higher to ensure that the developing device remains satisfactory in the development performance, and the peripheral velocity of the second development roller was set slower than that of the first development roller to minimize the toner adhesion to the background (production of foggy background). Therefore, the developing device in the first embodiment is smaller in the amount of "electrical charge injection frequency x electrical charge injection amount" per unit area of the peripheral surface of a photosensitive drum, and therefore, is unlikely to reduce in potential level the unexposed portion of an electrostatic image, that is, the portion to which no toner is to adhere.

Embodiment 2

The developing apparatus in the second embodiment of the present invention also employs two development rollers as shown in FIG. 2. It is based on the developing device in the first embodiment, being slightly different from the one in the first embodiment in that its upstream and downstream are both variable in peripheral velocity. This developing device is operated to find a range in which the developing device tolerable performance in terms of both the development performance and the minimization of toner adhesion to the background. In order to keep the developing device satisfactory for a long time in terms of the minimization (prevention) of the adherence of toner to the background of an electrostatic image, and also, the development performance, an experiment was carried out in which the downstream roller, to which the developer which tends to cause toner to adhere to the background portion of an electrostatic image is transferred from the upstream development roller, was varied in its peripheral velocity ratio relative to the photosensitive drum. Then, the results of the experiment were analyzed.

The control section 702 which is an example of controlling means controlled the developing device to vary the development roller 31 in peripheral velocity in such a manner that the lower in toner ratio the developer on the development roller 31, the lower the development roller 31 in peripheral velocity.

First, the peripheral velocity ratio Vt of the upstream development roller 21 was set to 1.6, and the peripheral velocity ratio of the downstream development roller 31 was varied in a range of 0.8-1.6. Then, the developing device was evaluated in terms of the adherence of toner to the background, and the development performance. The results of the experiment are shown in Table 10, in which "G and "N" indicate that the developing device remained, and failed to remain, respectively, above the tolerable level until the coating ratio fell to roughly 20% (target ratio).

TABLE 10

| | Sr | | | | |
|---|---|---|---|---|---|
| | 0.8 | 1 | 1.2 | 1.4 | 1.6 |
| Fog prevention | G | G | G | G | N |
| Developing property | N | N | G | G | G |

As is evident from Table 10, in terms of the foggy background, setting the peripheral velocity ratio Sr of the downstream development roller to a value smaller than the peripheral velocity ratio St of the upstream development roller kept the developing device above the tolerable level in performance. With respect to the development performance, it became evident that if the peripheral velocity ratio Sr of the downstream development roller relative to the photosensitive drum is set to be no more than 1.0, the developing device fails to remain at or above the tolerable level in performance.

In the second experiment, the peripheral velocity ratio St of the upstream development roller and the peripheral velocity ratio Sr of the downstream development roller were varied in several combinations in order to find out the combinations which can keep the developing device at or above the tolerable level in terms of both the background fogging prevention and the development performance. The results of the experiment are shown in Table 11, which shows the evaluation of the developing device under the various combinations of the peripheral velocity ratio St of the upstream development roller and the peripheral velocity ratio Sr of the downstream development roller, in terms of the background fogging/the development performance.

TABKE 11

| Fog Prevention/ Developing property | Sr = 0.8 | Sr = 1.0 | Sr = 1.2 | Sr = 1.4 | Sr = 1.6 |
|---|---|---|---|---|---|
| St = 1.2 | G/N | G/N | N/G | N/G | N/G |
| St = 1.4 | G/N | G/N | G/G | N/G | N/G |
| St = 1.6 | G/N | G/N | G/G | G/G | N/G |

As is evident from Table 11, in order to ensure that the developing device remains above the tolerable level in terms of the development performance while preventing the background fogging, the peripheral velocity Vr (mm/sec) of the downstream development roller, peripheral velocity Vd (mm/sec) of the photosensitive drum, and peripheral velocity Vt (mm/sec) of the upstream development roller have to be made to meet the following conditions:

(1) The peripheral velocity ratio Sr (=Vr/Vd) of the downstream development roller relative to the photosensitive drum is smaller than the peripheral velocity ratio St (=Vt/Vd) of the upstream development roller relative to the photosensitive drum; and (2) The peripheral velocity Vr of the downstream development roller is higher than the peripheral velocity Vd of the photosensitive drum.

<Study of Carrier Adhesion>

Figure 10:
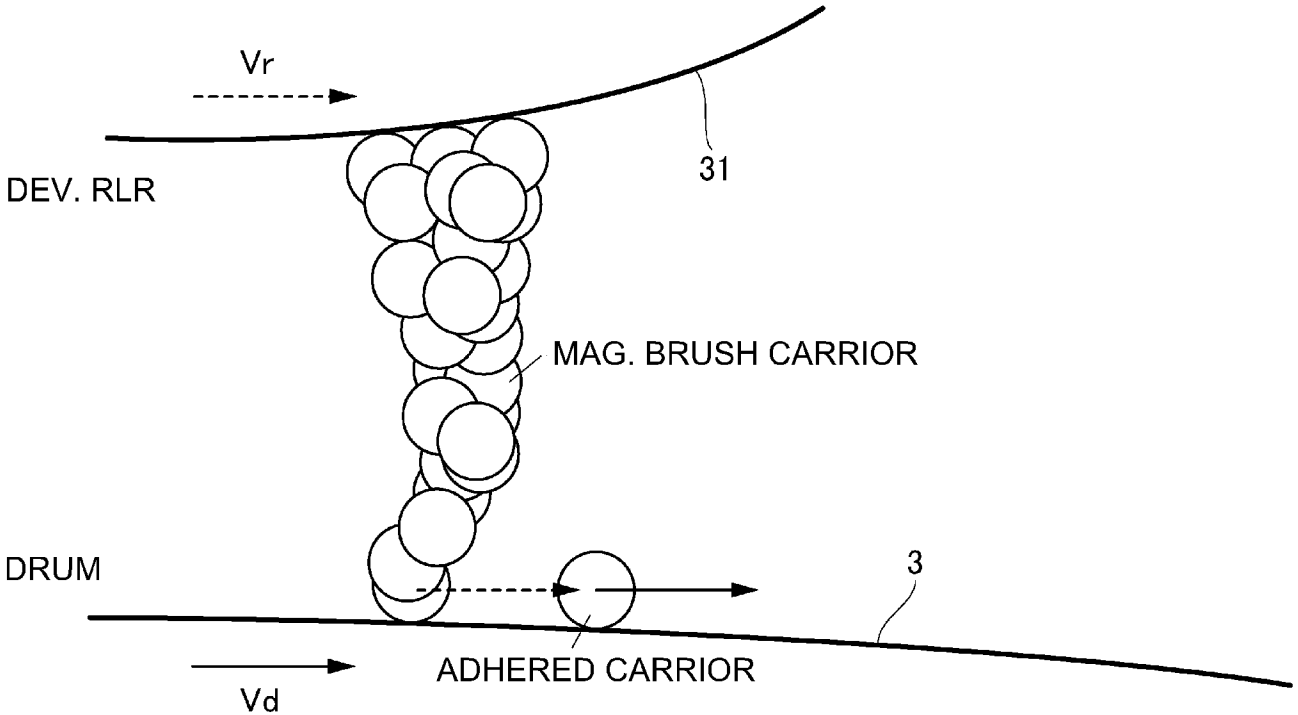
FIG. 10 is a schematic drawing of a magnetic brush in the development area.

FIG. 10 is a schematic drawing of the magnetic brush in the development area. It was discovered that if the peripheral velocity of the photosensitive drum is equal to the peripheral velocity of the downstream development roller, that is, if the peripheral velocity ratio Sr is 1.0, the amount by which carrier is adhered to the background is substantial. It was also discovered that the higher the photosensitive drum in peripheral velocity, the more conspicuous, the phenomenon that carrier is adhered to the background, which occurs when the peripheral velocity ratio S4 is 1.0.

Referring to FIG. 10, the higher the downstream development roller 31 in peripheral velocity, the greater the centrifugal force to which the carrier in the developer on the downstream development roller 31 is subjected, and therefore, the greater the amount by which the carrier is adhered to the photosensitive drum 3. However, the carrier adhered to the photosensitive drum 3 by the centrifugal force is weaker in the adhesiveness to the photosensitive drum 3 than the carrier adhered to the photosensitive drum 3 by electrostatic force. Therefore, it is thought that as long as a substantial amount of different (Vr−Vd) in peripheral velocity is provided between the photosensitive drum 3 and downstream development roller 31, the carrier adhered to the photosensitive drum 3 by the centrifugal force is captured (recovered) by the tip of the magnetic brush on the downstream development roller when the magnetic brush rubs it as the magnetic brush is made to outrun the carrier by the higher peripheral velocity of the downstream development roller.

However, if the peripheral velocity ratio Sr of the downstream development roller relative to the photosensitive drum 3 is 1.0, that is, if there is no difference in peripheral velocity between the downstream development roller and photosensitive drum 3, the magnetic brush cannot recover the carrier adhered to the peripheral surface of the photosensitive drum 3 by the centrifugal force. Therefore, the carrier remains on the peripheral surface of the photosensitive drum 3. That is, if the peripheral velocity ratio Sr of the downstream development roller relative to the photosensitive drum 3 is 1.0, the developing device increases in the amount by which the carrier in the developer on its downstream development roller is adhered to the peripheral surface of the photosensitive drum 3. The studies made by the inventors of the present invention about this subject revealed that in order to reduce the amount by which the carrier is adhered to the peripheral surface of the photosensitive drum 3, to a tolerable level, the developing device has to be set so that the peripheral velocity ratio Sr of the downstream development roller relative to the photosensitive drum 3 becomes no less than 1.1.

On the other hand, the study also revealed that if the developing device is set so that the peripheral velocity ratio of the downstream development roller relative to the photosensitive drum 3 becomes larger than a certain value, the carrier in the developing device is made to deteriorate at an accelerated rate.

Referring again to FIG. 10, the developer on the downstream development roller 31 is smaller in the amount of toner than the developer on the upstream development roller 21, by the amount by which toner was consumed for development while the developer was on the upstream development roller 21. In other words, the developer on the downstream development roller 31 is smaller in the amount of the toner which coats the carrier than the developer on the upstream development roller 21. Therefore, the development area between the downstream development roller 31 and photosensitive drum 3 is higher in the frequency with which the carrier in the tip portion of the magnetic brush directly rubs the peripheral surface of the photosensitive drum 3, therefore, making it more likely for the coating of the carrier to be peeled away, than the development area between the upstream development roller 21 and photosensitive drum 3. The studies made by the inventors of the present invention revealed that in order to keep the developing device above the tolerable level in terms of the carrier deterioration, the developing device has to be set so that the peripheral velocity ratio Sr of the downstream development roller 31 relative to the photosensitive drum 3 becomes no more than 1.5.

As will be evident from the description of the second embodiment, it is desired that the developing device is set so that the peripheral velocity ratio of the downstream development roller relative to the photosensitive drum becomes no less than 1.1 and no more than 1.5, because setting the developing device in such a manner can prevent or minimize the problem that increasing an image forming apparatus in process speed increases the amount by which carrier is adhered to the peripheral surface of the photosensitive drum, and accelerates the speed at which the carrier is deteriorated.

As a method for increasing the developing device in the ratio of the coating of the carrier by the toner, in the magnetic brush on the downstream development roller 31, it is thinkable to increase the developer in the developing device in the initial amount of toner, or increase the developing device in the frequency with which it is replenished with toner. The employment of such a method makes it possible to prevent the developing device becoming excessively low in the electrical resistance of the developer on its downstream development roller. However, increasing the developing device in the amount of the toner in its initial supply of developer reduces the frequency with which the toner is frictionally charged by the carrier in the developing device, which in turns reduces the developing device in the average amount Q/M of toner charge. Therefore, the image forming apparatus is likely to output a foggy image immediately after an image forming operation is started. On the other hand, if the developing device is increased in the frequency with which it is replenished with toner, it is likely to begin to adhere toner to the background immediately after the replenishment, because as the developing device is replenished with toner, the developer in the developing device reduces in the average amount Q/M of toner charge. Further, increasing the frequency with which the developing device is replenished with toner increases the amount of toner consumption by the developing device, which naturally increases image formation cost. In other words, it may burden a user. Further, replenishing the developing device with toner by an amount which exceeds the amount of toner consumption for the ongoing image forming operation ends up wasting toner, which is undesirable from the stand point of environmental protection.

Embodiment 3

Figure 11:
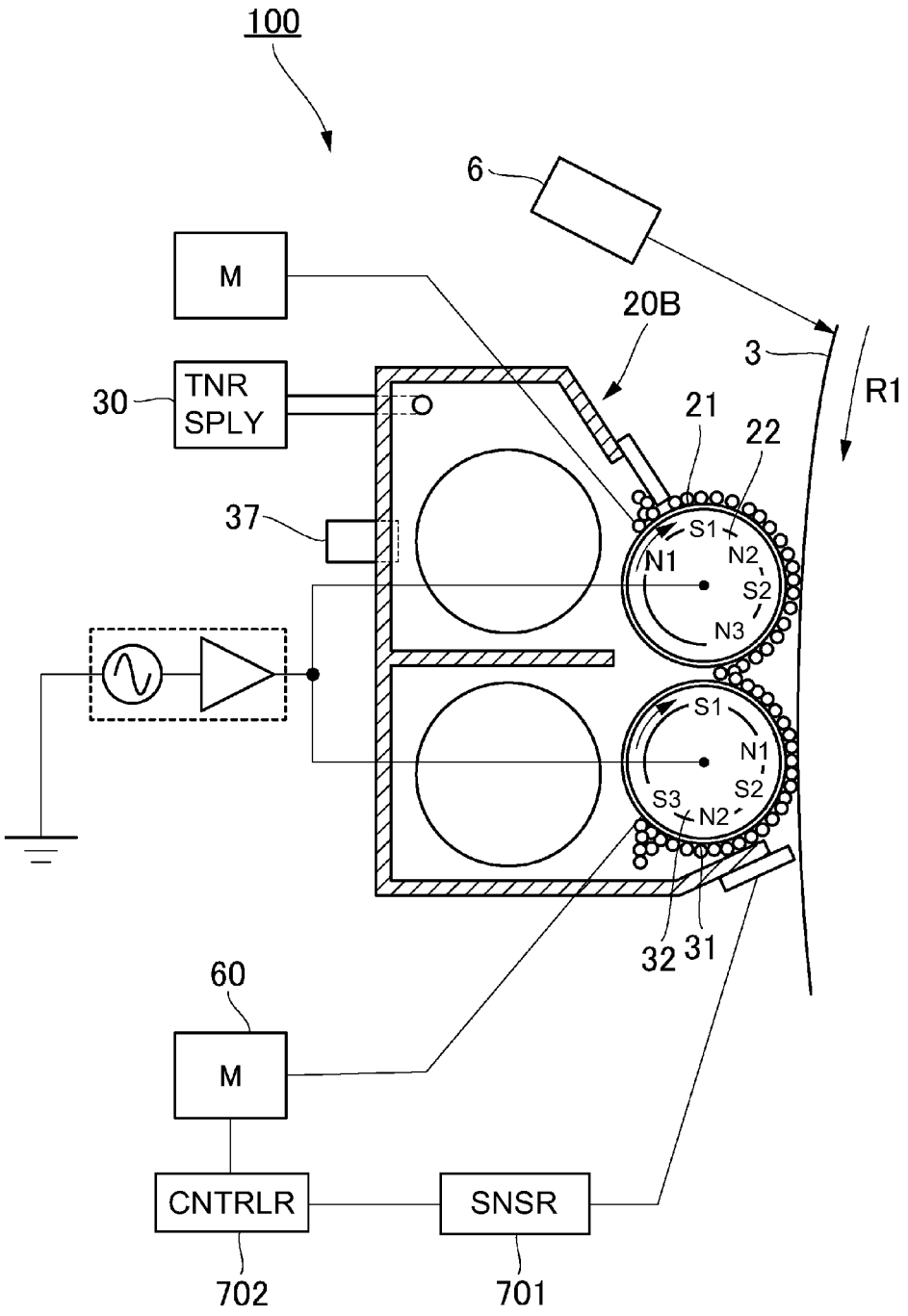
FIG. 11 is a schematic sectional view of the developing device in the third embodiment of the present invention, and shows the general structure of the device.
Figure 12:
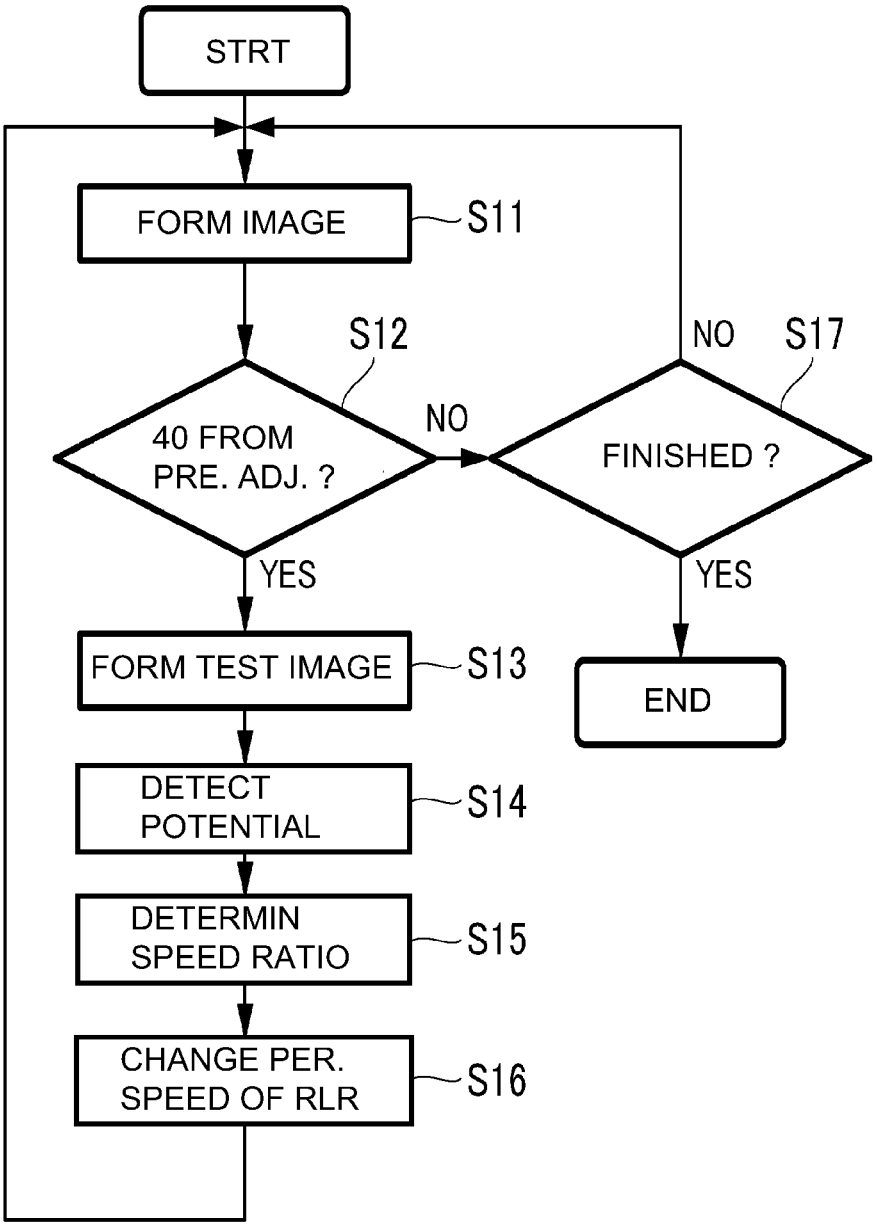
FIG. 12 is a flowchart of the control sequence for the developing device in the third embodiment.
Figure 13:
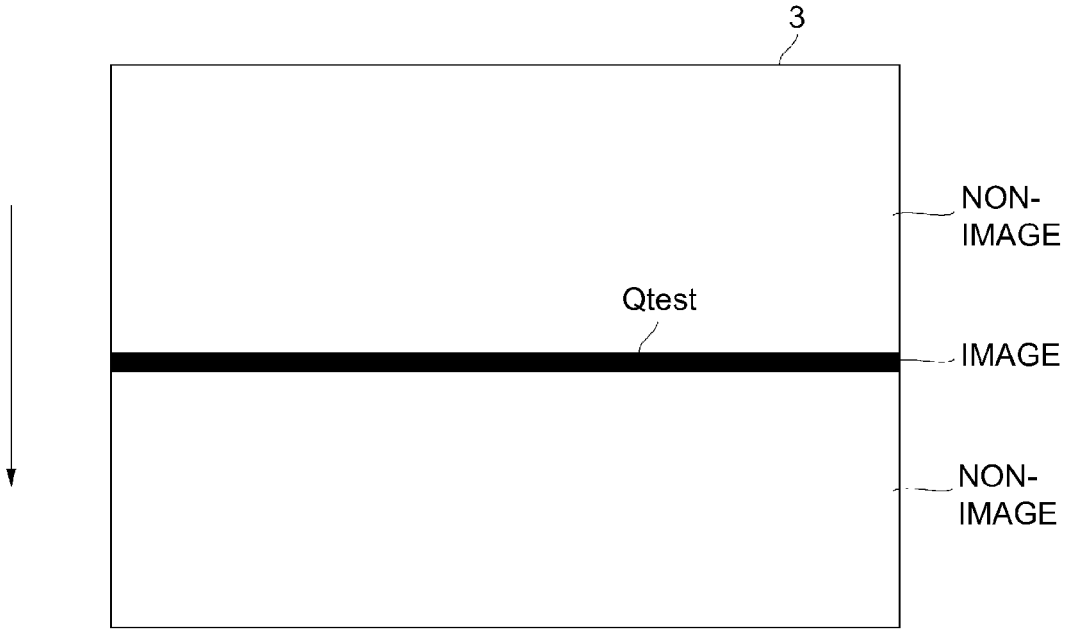
FIG. 13 is a drawing of a test electrostatic image to be formed in the adjustment mode to control the developing device in the third embodiment.
Figure 14:
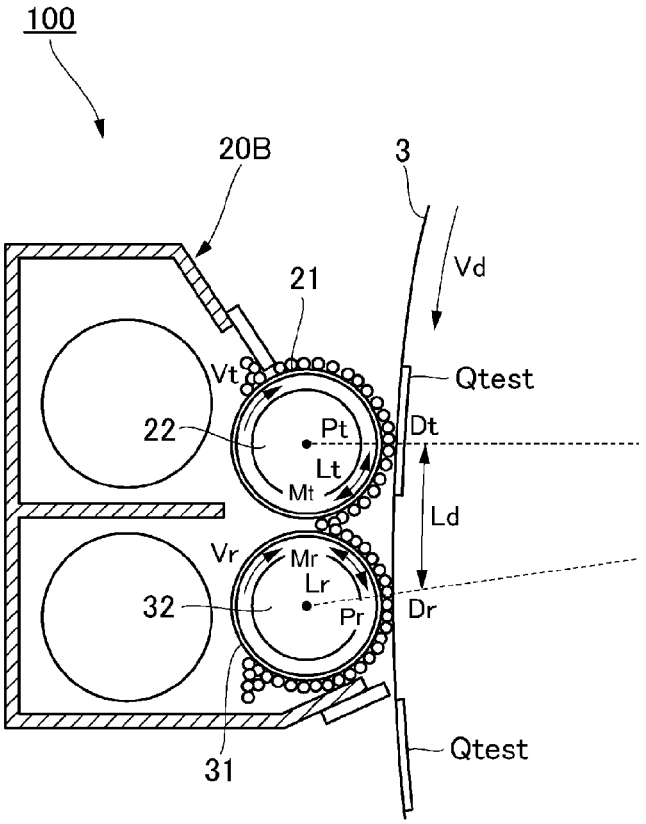
FIG. 14 is a schematic sectional view of a combination of the developing device and photosensitive member, which shows where the potential level of the test electrostatic image is detected.
Figure 15:
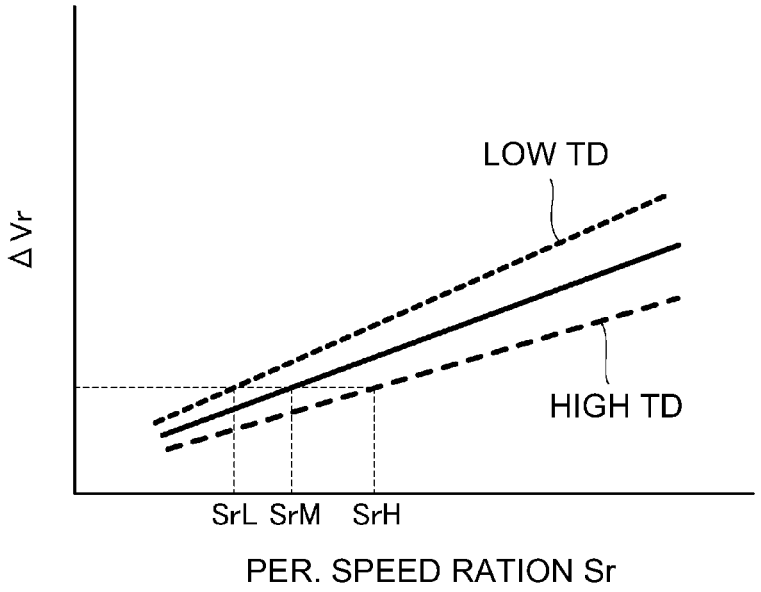
FIG. 15 is a graph which shows the relationship between the ratio in peripheral velocity between the downstream development roller and photosensitive drum, and the difference between the detected amount of potential levels of the upstream and downstream unexposed portions of the test electrostatic image, with reference to the exposed portion of the test electrostatic image, in terms of the rotational direction of the photosensitive member.
Figure 16:
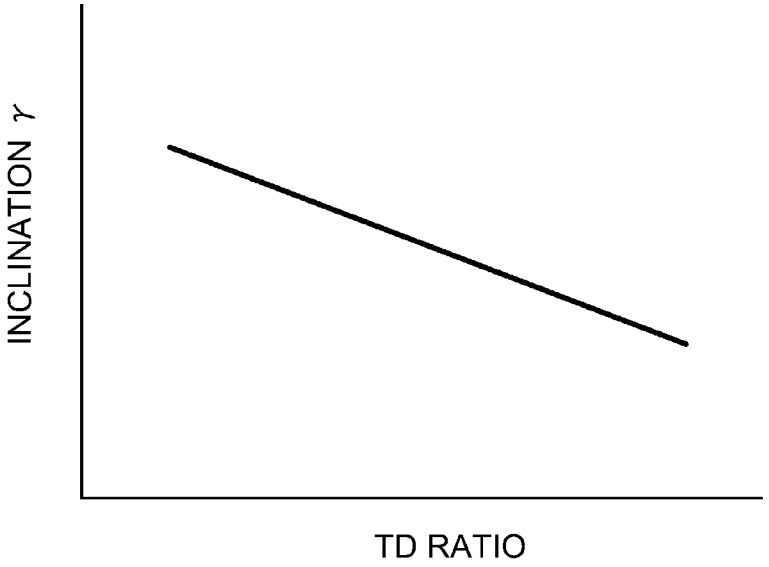
FIG. 16 is a graph which shows the proportional relationship (factor of proportionality being γ) between the TD ratio and the peripheral velocity ratio of the downstream development roller relative to the photosensitive drum.

FIG. 11 is a schematic sectional view of the developing device in the third embodiment of the present invention. It shows the general structure of the device. FIG. 12 is a flowchart of the control sequence for the device shown in FIG. 11. FIG. 13 is a drawing of the test electrostatic image used for controlling the developing device in the third embodiment. FIG. 14 is a schematic sectional view of the developing device in the third embodiment, and a part of the peripheral surface of the photosensitive drum, which is for describing the points at which the test electrostatic image is to be detected. FIG. 15 is a graph which shows the relationship between the peripheral velocity ratio of the downstream development roller relative to the photosensitive drum, and the difference between the detected potential level of the upstream and downstream unexposed portions of an electrostatic image, relative to the exposed portion of the electrostatic image, in terms of the moving direction of the peripheral surface of the photosensitive drum. FIG. 16 is a graph which shows the relationship among the TD ratio, peripheral velocity ratio Sr of the downstream development roller relative to the photosensitive drum, and difference in potential level between the upstream and downstream unexposed areas of the electrostatic image, relative to the exposed portion of the electrostatic image.

In the third embodiment, an image forming operation for forming a substantial number of images is interrupted for every 40 images to operate the image forming apparatus in an adjustment mode in which the amount of the fog prevention contrast Vback is detected, and the developing device is adjusted in the peripheral velocity Vr of its downstream development roller, based on the detected amount of fog prevention contrast Vback. Thus, this embodiment can further improve a developing device in performance in terms of development performance, and prolong the length of time toner is prevented from adhering to the background.

Referring to FIG. 11, the developing device 20B in the third embodiment has a detection section 701 which is an example of potential level detecting means. The detection section 701 detects the potential level of the peripheral surface of the photosensitive drum 3 after the rubbing of the peripheral surface of the photosensitive drum 3 by the magnetic brush of the development roller 31. The control section 702 which is an example of a controlling means sets the peripheral velocity of the development roller 31 in such a manner that the smaller in absolute value the potential level of the unexposed portion of an electrostatic image, the lower the peripheral velocity of the development roller 31, based on the potential level of the peripheral surface of the photosensitive drum 3. It is during an image formation interval that the control section 702 operates the image forming apparatus in the mode in which the peripheral velocity of the development roller 31 is set. More specifically, in the peripheral velocity setting mode, a test electrostatic image made up of an exposed portion (to which toner is to be adhered), and a pair of unexposed portions (to which toner is not to be adhered) which are on the upstream and downstream sides, one for one, of the exposed portion, in terms of the rotational direction of the photosensitive drum 3. First, the potential level of the downstream unexposed portion of the electrostatic image, relative to the exposed portion of the electrostatic image, is detected after the portion was rubbed by the magnetic brush on the downstream development roller 31. Then, the peripheral velocity of the downstream development roller 31 is set based on the detected potential level of the downstream unexposed portion.

The developing device 20B is provided with the detection section 701, which measures the surface potential level of the photosensitive drum 3 at a point which is on the downstream side of the point at which the distance between the development roller 31 and photosensitive drum 3 is smallest, in terms of the rotational direction of the photosensitive drum 3.

The detection section 702 is made up of a potentiometer of the non-contact type. It is for measuring the potential level of the peripheral surface of the photosensitive drum 3 at a point which is on the downstream side of the point at which the distance between the downstream development roller 31 (to which developer is transferred from the upstream development roller 21) and the photosensitive drum 3, in terms of the moving direction of the peripheral surface of the photosensitive drum 3. As it detects the surface potential level of the photosensitive drum 3, it outputs to the control section 702, the signal which reflects the detected surface potential level of the photosensitive drum 3.

Next, referring to FIG. 12 along with FIG. 11, as the control section 702 receives an image formation job, it starts an image forming operation (S11).

As the image formation count started after the adjustment of the peripheral velocity of the downstream development roller 31 reaches 40 (YES in S12), the control section 702 forms a test electrostatic image Qtest on the peripheral surface of the photosensitive drum 3 with the use of the exposing device 6 which is set to the maximum output (S13), as shown in FIG. 13.

Referring to FIG. 14, as the electrostatic image Qtest is developed by the developing device 20B, it robs the upstream development roller 21 of toner by the maximum amount. Thus, the developer on the upstream development roller 21 reduces in toner ratio, which in turn reduces the developer in electrical resistance. Then, the developer on the upstream development roller 21 having reduced in electrical resistance is transferred onto the downstream development roller 31, and forms a magnetic brush which is lower in electrical resistance and rubs photosensitive drum 3. After the magnetic brush formed on the upstream development roller 21 rubbed the electrostatic image on the photosensitive drum, it is lower in electrical resistance than before it rubbed the electrostatic image on the photosensitive drum.

Thus, there is a difference Δr between the measured amount of potential levels Vn of the upstream and downstream unexposed portions of the electrostatic image of the test electrostatic image Qtest relative to the exposed portion of the test electrostatic image Qtest. This difference ΔVr is proportional to the amount by the developer (magnetic brush) was reduced in electrical resistance by the development of the exposed portion of the electrostatic image Qtest.

The control section 702 detects the potential level Vn of the unexposed portion of the test electrostatic image Qtest with the use of the detection section 701 on the upstream and downstream side of the exposed portion of the test electrostatic image Qtest (S14).

Then, the control section 702 determines the peripheral velocity ratio Sr of the downstream development sleeve 31 based on the difference ΔVr in potential level, with reference to a lookup table which shows the relationship between the preset values for the peripheral velocity ratio of the downstream development sleeve 31 and potential level difference ΔVr (S15).

Then, the control section 702 determines the proper value for the peripheral velocity of the downstream development sleeve 31, based on the peripheral velocity ratio Sr of the downstream development sleeve 31 relative to the photosensitive drum 3 and the peripheral velocity Vd of the photosensitive drum 3, and outputs a control signal for the motor 60 (S16).

After changing the downstream development sleeve 31 in peripheral velocity Vr, the control section 702 restarts the interrupted image forming operation (S11). As the image forming operation ends (NO in S12→YES in S17), the control section 702 stops the image forming apparatus.

Referring to FIG. 13, the test electrostatic image Qtest is made up of the two unexposed portions and the one exposed portion (which is to become toner-covered solid portion of visible image as electrostatic image is developed).

Referring again to FIG. 5, as the test electrostatic image Qtest is developed with toner, its exposed portions increases in potential level by the amount equal to the potential ΔV generated by the toner adhered to the exposed portions.

The surface potential level of the photosensitive drum detected by the detection section 701 on the upstream side of the test electrostatic image Qtest is different from that on the downstream side. The potential level of the unexposed portion of the test electrostatic image Qtest on the downstream side of the exposed portion of the test electrostatic image Qtest is different by ΔVr from that on the upstream side. The potential difference ΔVr equals the amount by which the fog prevention contrast is changed by the amount by which electrical charge is injected into the photosensitive drum 3 by the downstream development sleeve 31.

Referring to FIG. 14, the test electrostatic image Qtest moves at a speed which equals the peripheral velocity Vd of the photosensitive drum 3. Thus, the length td of time it takes for a given point on the peripheral surface of the photosensitive drum 3 to travel across a distance Ld between the point Dt on the peripheral surface of the photosensitive drum 3, at which the distance between the photosensitive drum 3 and development roller 21 is shortest, and the point Dr on the peripheral surface of the photosensitive drum 3, at which the distance between the photosensitive drum 3 and development roller 31 is shortest, can be expressed by the following Mathematical Formula 7:

$$t_d(s) = \frac{L_d}{V_d} \tag{7}$$

As for the length tp of time it takes for the developer on a given point on the peripheral surface of the development roller 21 to travel from a point Pt at which the peripheral surface of the upstream development roller 21 is closest to the peripheral surface of the photosensitive drum 3, to a point Pr at which the peripheral surface of the downstream development roller 31 is closest to the peripheral surface of the photosensitive drum 3, it can be expressed by the following Mathematical Formula 8, in which "Lt" stands for the distance between the position of the developer transfer magnetic pole Mt of the upstream magnetic member 22, and the position Pt, and "Lr" stands for the distance between the position of the developer reception pole Mr of the downstream magnetic member 32, and the position Pr.

$$t_p(s) = \frac{Lt}{V_t} + \frac{Lr}{V_r}. \quad (8)$$

If "tp" is smaller than "td", by the time the developer on the upstream development roller 21, from which toner was consumed for the development of the exposed portion of the test electrostatic image Qtest reaches the position Pr on the downstream development roller 31, the photosensitive drum 3 will have rotated by such an angle that the developer on the position Pr of the downstream development roller 31 will face the unexposed portion of the test electrostatic image Qtest, which is on the downstream side of the exposed portion of the test electrostatic image Qtest. Therefore, the potential level of the unexposed portion of the test electrostatic image Qtest on the upstream side of the exposed portion of the test electrostatic image Qtest is different in potential level by the amount ΔVr from that on the downstream side.

If "tp" is greater than "td", by the time the developer on the upstream development roller 21, from which toner was consumed for the development of the exposed portion of the test electrostatic image Qtest reaches the position Pr of the downstream development roller, the photosensitive drum 3 will have rotated by an such an angle that the developer on the position Pr of the downstream development roller 21 will face the unexposed portion of the test electrostatic image Qtest, which is on the upstream side of the exposed portion of the test electrostatic image Qtest. That is, the unexposed portion of the test electrostatic image Qtest, which is on the downstream side of the exposed portion of the test electrostatic image Qtest, becomes different in potential level by the amount ΔVr from the unexposed portion of the test electrostatic image Qtest, which is on the upstream side of the exposed portion of the test electrostatic image Qtest, because of the injection of electrical charge into the photosensitive drum 3.

Therefore, the amount ΔVr can be obtained from the potential level, detected by the detection section 701, of the unexposed portion of the test electrostatic image Qtest, which is on the upstream side of the exposed portion of the test electrostatic image Qtest, and that which is on the downstream side of the exposed portion of the test electrostatic image Qtest. The electrical charge is injected into the photosensitive drum in such a manner that the potential level Vn (−480 V) of the exposed portion converges to the potential level Vdc (−330 V) of the development roller. Therefore, the amount ΔVr never becomes negative: ΔVr=|Vn (occurrence of electrical charge injection)−Vn (no electrical charge injection)|≥0.

In this embodiment, the developer is significantly reduced in electrical resistance by the toner consumption therefrom. Therefore, it may be only the potential level of the exposed portion of the test electrostatic image Qtest, which reduced in the potential level, that is to be detected by the detection section 702. That is, the potential level of the unexposed portion of the test electrostatic image Qtest may be substituted with the referential potential level stored in the memory. In such a case, the amount ΔVr is obtained as the amount of difference between the potential level detected by the detection section 701 and the referential potential level in the memory.

Next, referring to FIG. 15, the potential level difference ΔVr is proportional to the peripheral velocity ratio Sr of the downstream development roller 31, and the constant of proportionality is γ. Therefore, the smaller the peripheral velocity ratio Sr, the smaller the amount by which the fog prevention voltage Vback is reduced. The constant γ of proportionality is affected by the above described coating ratio, that is, the TD ratio of the developer. Therefore, the relationship between the constant γ of proportionality and the TD ratio, which is shown in FIG. 16, can be stored in the form of a lookup table.

The control section 702 sets a value for the constant γ of proportionality, based on the TD ratio of the developer, which was actually measured by the developing device 20, with reference to the lockup table shown in FIG. 16. Then, based on the value set for the constant γ of proportionailty, it sets such a value for the peripheral velocity ratio Sr of the downstream development roller 31 that the amount ΔVr of the potential level difference becomes smaller than a preset value (no more than 5 V in third embodiment). After the image forming apparatus was operated in the adjustment mode in which the peripheral velocity of the downstream development roller 31 was set to the optimal value, the formation of the next 40 images is started, with the speed of the motor 60 being set by the control section 702 to the value which rotates the downstream development roller 31 at the peripheral velocity set in the adjustment mode. The image forming apparatus is operated in the adjustment mode for every 40 images.

In the adjustment mode, the peripheral velocity ratio Vt of the upstream development roller relative to the photosensitive drum was set to 1.6, and the peripheral velocity ratio Vr of the downstream development roller relative to the photosensitive drum was varied within a range of 0.8-1.6. The image forming apparatus was operated in the adjustment mode after the 40th, 80th, 120th, 160th, 200th and 240th images. While the image forming apparatus was operated in the adjustment mode, the developing device was not replenished with toner, and the process speed was 700 mm/sec. The values to which the peripheral velocity ratio Sr of the downstream development roller relative to the photosensitive drum was set after the 40th, 80th, 120th, 160th, 200th and 240th images in the third embodiment are given in Table 12 along with the values to which the peripheral velocity ratio Sr of the downstream development roller relative to the photosensitive drum was set after the 40th, 80th, 120th, 160th, 200th and 240th images as in the first embodiment.

TABLE 12

| | No. of Images | | | | | |
|---|---|---|---|---|---|---|
| | 40 | 80 | 120 | 160 | 200 | 240 |
| Sr (Emb. 1) | 1.2 | 1.2 | 1.2 | 1.2 | 1.2 | 1.2 |
| Sr (Emb. 3) | 1.6 | 1.5 | 1.4 | 1.4 | 1.3 | 1.2 |

As is evident from Table 12, in the first embodiment, the peripheral velocity ratio Sr was fixed to 1.2, whereas in the third embodiment, the peripheral velocity ratio Sr was set higher than the counterparts in the first embodiment, up to the 240th print up to which the TD ratio was high. The images outputted immediately after the image forming apparatus was operated in the adjustment mode after the 40th, 80th, 120th, 160th, 200th and 240th images were evaluated in terms of the prevention of the background fog and the development performance. The results of the evaluation are given in Table 13, the cells of which, excluding those in the top row and left end column, show the combined evaluation of the images in terms of the background fog and the actual image portion.

TABLE 13

| | No. of Images | | | | | |
|---|---|---|---|---|---|---|
| | 40 | 80 | 120 | 160 | 200 | 240 |
| Evaluation (Emb. 1) | A/A | A/A | A/B | A/B | B/B | B/B |
| Evaluation (Emb. 3) | A/A | A/A | A/A | A/A | B/A | B/B |

As is evident from Table 13, in the third embodiment, the image forming apparatus (developing device) was controlled so that the image forming apparatus was operated in the adjustment mode for every preset number of images to set the peripheral velocity ratio Sr of the downstream development roller relative to the photosensitive drum to an optimal value, in order not to unnecessarily reduce the downstream development roller 31 in peripheral velocity. Therefore, the third embodiment can keep the developing device at a tolerable or higher level in terms of its development performance, for a longer period of time than the first embodiment. That is, by operating an electrophotographic image forming apparatus in the adjustment mode in the third embodiment, not only is it possible to prevent the developing device from adhering toner to the background, but also, diminishing the developing device in its development performance, regardless of whether the apparatus is used for continuously outputting a substantial number of images (images), changes in the ambience of the apparatus, changes in the condition of the apparatus attributable the elapse of time.

The timing with which an image forming apparatus is to be operated in the adjustment mode does not need to be limited to the sheet interval in an image forming operation in which a substantial number of images are continuously formed. That is, an image forming apparatus may be operated in the adjustment mode any time, as long as the apparatus is not actually forming an image. For example, the timing may be during the pre- or post-rotation of every job.

Embodiment 4

Figure 17:
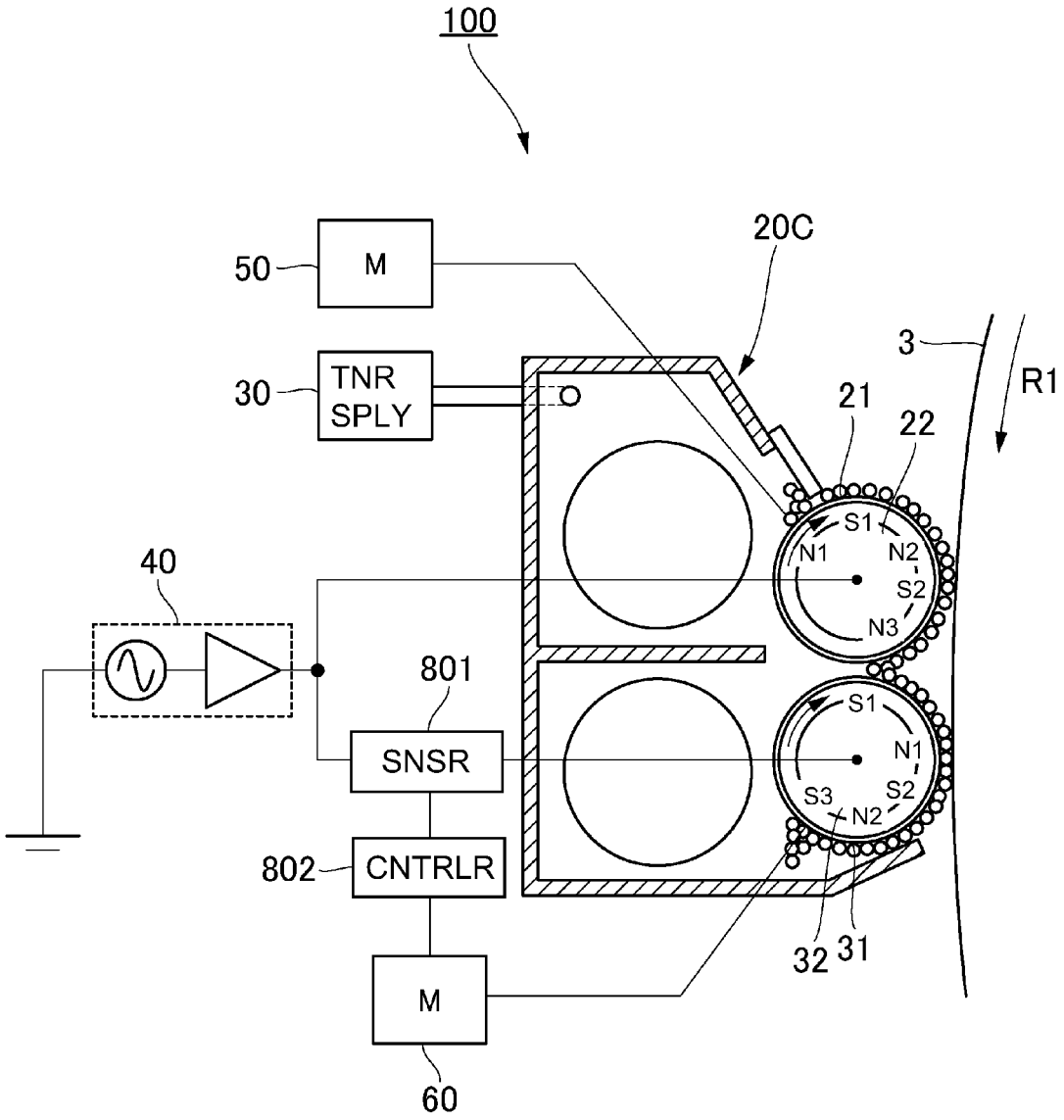
FIG. 17 is a schematic sectional view of the developing device in the fourth embodiment, and shows the general structure of the device.
Figure 18:
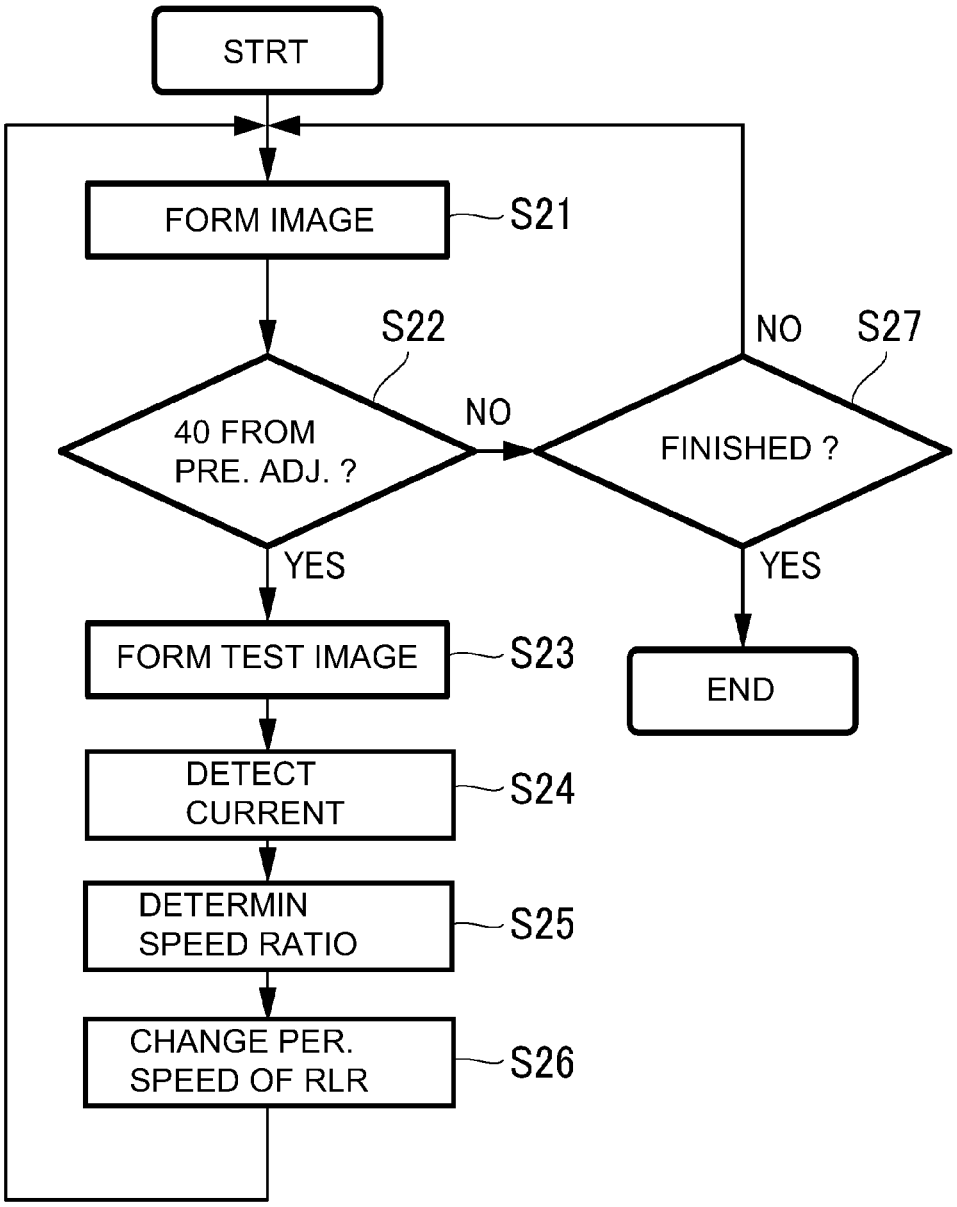
FIG. 18 is a flowchart of the control sequence of the developing device in the fourth embodiment.
Figure 19:
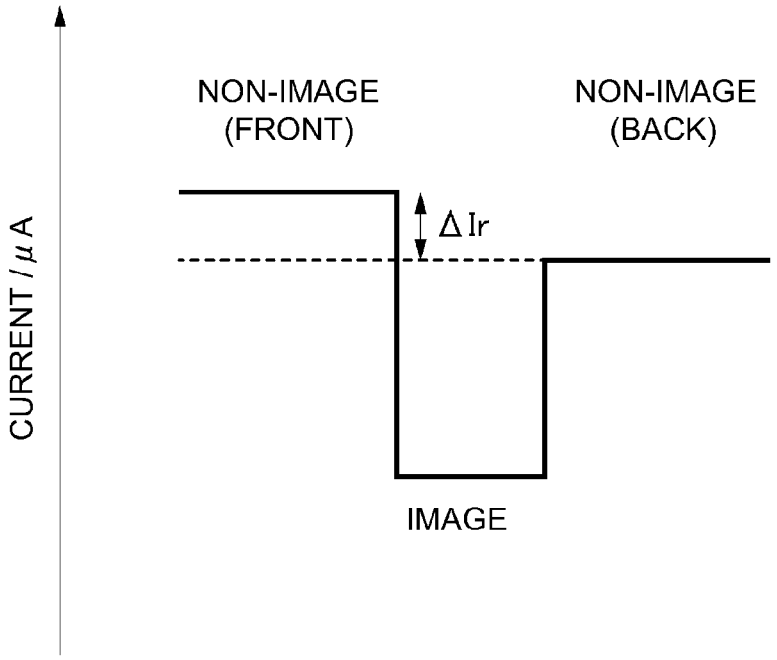
FIG. 19 is a drawing for describing the relationship in terms of potential level between the upstream and downstream exposed portions of the test electrostatic image, relative to the exposed portion of the test electrostatic image, in terms of the rotational direction of the photosensitive drum.
Figure 20:
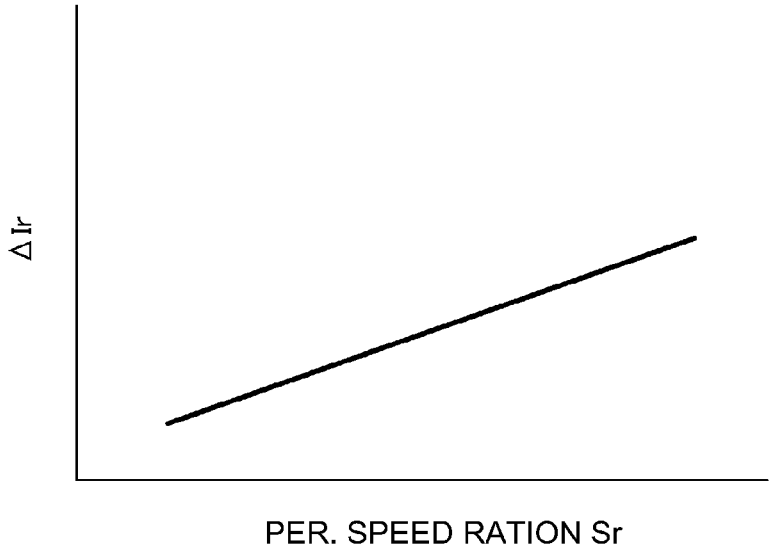
FIG. 20 is a graph which shows the relationship between the ratio in peripheral velocity between the downstream development roller and photosensitive drum, and the difference between the detected amount of electrical current of the upstream unexposed portion of the test electrostatic image, and that of the downstream unexposed portion of the test electrostatic image, with reference to the exposed portion of the test electrostatic image, in terms of the rotational direction of the photosensitive member.

FIG. 17 is a schematic sectional view of the developing device in the fourth embodiment of the present invention. It shows the general structure of the device. FIG. 18 is a flowchart of the control sequence for the device shown in FIG. 17. FIG. 19 is a drawing for describing the relationship between the amount of electrical current of the unexposed portion of the electrostatic image, which is on the upstream side of the exposed portion of the electrostatic image, and that on the downstream side. FIG. 20 is a graph which shows the relationship between the peripheral velocity ratio Sr of the downstream development roller and the amount of difference between the amount of electrical current of the unexposed portion of the electrostatic image, which is on the upstream side of the exposed portion of the electrostatic image, and that on the downstream side.

In the fourth embodiment, an image forming operation for continuously forming a substantial number of images is interrupted for every 40 images to operate the image forming apparatus in the adjustment mode in which the peripheral velocity Vr of the downstream development roller was adjusted by detecting the amount by which electric current flows through the downstream development roller. This embodiment also can prevent toner from adhering to the background, preventing thereby the formation of a foggy image. Further, this embodiment can keep a developing device at a higher level of the development performance than the preceding embodiments.

Referring to FIG. 17, the developing device 20C in the fourth embodiment is provided with a detection section 801 and a control section 802. The detection section 801, which is an example of a current amount detecting means, detects the amount of the current which flows between the development roller 31 and photosensitive drum 3. The control section 802 sets the peripheral velocity of the development roller 31 based on the detected amount of the current so that the smaller the amount by which the direct current flows through the development roller 31 as the magnetic brush on the development roller 31 rubs becomes, the slower the development roller 31 becomes in peripheral velocity.

More specifically, the developing device 20C is provided with the detection section 801 which detects the amount of the electrical current which flows between the development roller 31 and an oscillating device 40. It is a current detection circuit made up of a pair of resistors connected in series, and a voltmeter. It detects the amount of electrical current which flows between the pair of resistors by measuring the amount of voltage drop which occurs between the pair of resistors. As the detection section 801 detects the amount of current which flows through the development roller 31, it outputs to the control section 802, a signal which indicates the detected amount of current.

Referring to FIG. 18 along with FIG. 17, as the control section 802 receives an image formation job, it starts an image forming operation (S21).

As the image formation count started after the adjustment of the peripheral velocity of the downstream development roller 31 reaches 40 (YES in S22), the control section 802 forms the test electrostatic image Qtest, shown in FIG. 13, on the peripheral surface of the photosensitive drum 3 with the use of the exposing device 6 which is set to the maximum output (S23).

Referring to FIG. 19, the amount by which electrical current flows through the development roller 31, on the upstream side of the exposed portion of the test electrostatic image Qtest, and that on the downstream side, are measured, obtaining thereby the amount ΔIr of difference between the amount of the current on the upstream and downstream sides of the exposed portion of the test electrostatic image Qtest, which corresponds to the amount by which the developer is reduced in electrical resistance by the development of the exposed portion of the test electrostatic image Qtest.

Then, the control section 802 obtains the amount ΔIr of difference by measuring the amount of the electrical current which flows through the development roller 31, on the upstream and downstream sides of the exposed portion of the electrostatic image (S24).

Then, the control section 802 determines a proper value for the peripheral velocity Vr of the downstream development sleeve 31, with reference to a lookup table which shows the relationship between the peripheral velocity ratio Sr of the downstream development sleeve 31 relative to the photosensitive drum 3, and the amount ΔIr of difference (S25).

After changing the downstream development sleeve 31 in peripheral velocity Vr (S26), the control section 802 restarts the interrupted image forming operation (S21). As the image forming operation ends (YES in S27), the control section 802 stops the image forming apparatus.

Referring to FIG. 13, the test electrostatic image Qtest is made up of upstream and downstream unexposed portion and an exposed portion (which corresponds to solid image portion of developed electrostatic image).

Referring to FIG. 5, the unexposed portion of the test electrostatic image Qtest, which is on the upstream side of the exposed portion of the test electrostatic image Qtest, is different in the fog prevention contrast Vback, from the unexposed portion of the test electrostatic image Qtest, which is on the downstream side, as described above. Therefore, the amount of the electric current flowed through the downstream development roller 31 by the fog prevention contrast Vback is different from that on the upstream side, as shown in FIG. 19. That is, the detected amount of the electrical current flowed through the downstream unexposed portion of the test electrostatic image Qtest is smaller than that through the downstream unexposed portion of the test electrostatic image Qtest, by the amount ΔIr which corresponds to the difference between the amount by which electrical charge is injected through the magnetic brush into the upstream exposed portion of the test electrostatic image Qtest, and the amount by which electrical charge is injected through the magnetic brush into the downstream exposed portion of the test electrostatic image Qtest.

Referring to FIG. 20, the amount ΔIr of the difference between the amount of the electrical current which flows between the upstream exposed portion of the test electrostatic image Qtest and the upstream development roller, and that which flows between the downstream exposed portion of the test electrostatic image Qtest and the downstream development roller is proportional to the peripheral velocity ratio Sr of the downstream development roller relative to the photosensitive drum 3, wherein the factor of proportionality is γ. Therefore, the slower the peripheral velocity ratio Sr, the smaller the amount by which the fog prevention voltage Bback is reduced. The factor γ of proportionality is related to the above described coating ratio, that is, the TD ratio of the developer. Therefore, the relationship between the factor γ of proportionality and the TD ratio can be stored in the form of a lookup table, as in the third embodiment. The control section 802 selects a proper value for the factor γ of proportionality based on the actually measured TD ratio of the developer in the developing device 20C, with reference to the lookup table. Then, based on the selected value, it selects for the peripheral velocity ratio Sr of the downstream development roller relative to the photosensitive drum 3, such a value that makes the amount ΔIr of the difference between the amount of the electrical current which flows between the upstream exposed portion of the test electrostatic image Qtest and the downstream development roller, and that which flows between the downstream exposed portion of the test electrostatic image Qtest and the downstream development roller will becomes no more than a desired amount.

In the adjustment mode, the peripheral velocity ratio Vt of the upstream development roller relative to the photosensitive drum was set to 1.6, and the peripheral velocity ratio Vr of the downstream development roller relative to the photosensitive drum was varied within a range of 0.8-1.6. The image forming apparatus was operated in the adjustment mode after the 40th, 80th, 120th, 160th, 200th and 240th images. While the image forming apparatus was operated in the adjustment mode, the developing device was not replenished with toner, and the process speed was 700 mm/sec. The values to which the peripheral velocity ratio Sr of the downstream development roller relative to the photosensitive drum was set after the 40th, 80th, 120th, 160th, 200th and 240th images in this embodiment were given in Table 14 along with the values to which the peripheral velocity ratio Sr of the downstream development roller relative to the photosensitive drum was set after the 40th, 80th, 120th, 160th, 200th and 240th images in the first embodiment.

TABLE 14

| | No. of Images | | | | | |
|---|---|---|---|---|---|---|
| | 40 | 80 | 120 | 160 | 200 | 240 |
| Sr (Emb. 1) | 1.2 | 1.2 | 1.2 | 1.2 | 1.2 | 1.2 |
| Sr (Emb. 4) | 1.6 | 1.5 | 1.4 | 1.4 | 1.3 | 1.2 |

As is evident from Table 14, in the first embodiment, the peripheral velocity ratio Sr was fixed to 1.2, whereas in the fourth embodiment, the peripheral velocity ratio Sr was set higher than the counterpart in the first embodiment, when the TD ratio was high. The images outputted immediately after the image forming apparatus was operated in the adjustment mode after the 40th, 80th, 120th, 160th, 200th and 240th images were evaluated in terms of the background fog prevention and the development performance. The results of the evaluation are given in Table 15, the cells of which, excluding those in the top row and left end column, show the combined evaluation of the images in terms of the background fog and the quality of the actual image portion.

TABLE 15

| | No. of Images | | | | | |
|---|---|---|---|---|---|---|
| | 40 | 80 | 120 | 160 | 200 | 240 |
| Evaluation (Emb. 1) | A/A | A/A | A/B | A/B | B/B | B/B |
| Evaluation (Emb. 4) | A/A | A/A | A/A | A/A | B/A | B/B |

As is evident from Table 15, in the fourth embodiment, the image forming apparatus (developing device) was controlled so that the image forming apparatus was operated in the adjustment mode for every preset number of images to set the peripheral velocity ratio Sr of the downstream development roller relative to the photosensitive drum to an optimal value, in order not to unnecessarily reduce the downstream development roller 31 in peripheral velocity. Therefore, the fourth embodiment can keep the developing device at a tolerable or higher level in terms of its development performance, for a longer period of time than the first embodiment.

Embodiment 5

Referring to FIG. 2, in the fifth embodiment of the present invention, the peripheral velocity Vr of the downstream 31 is reduced in proportion to the reduction in the toner ratio of the developer in the developing device 20. The control section 702 calculates the toner ratio of the developer in the developing device 20, based on the output of the TD ratio sensor 37.

The TD ratio sensor 37 which is an example of toner ratio detecting means detects the toner ratio of the developer before the developer is borne on the development roller 31. The control section 702 controls the motor 60, based on the detected toner ratio, so that the lower the developer in toner ratio before it is borne on the development roller 31, the slower the development roller 31 in peripheral velocity.

The control section 702 determines the factor γ of proportionality (FIG. 16) between the potential level difference ΔVr and the peripheral velocity ratio Sr of the development roller 31 relative to the photosensitive drum, based on the actually measured TD ratio of the developer in the developing device 20. Then, the control section 702 creates a table which shows the relationship among the potential difference ΔVr, factor γ of proportionality, and the peripheral velocity ratio Sr of the downstream development roller relative to the photosensitive drum. Then, it sets the peripheral velocity ratio Sr of the downstream development roller relative to the photosensitive drum so that the potential level difference ΔVr remains below a preset level, below which the fog prevention contrast remains sufficient. The motor 60 drives the development rollers 21 and 31 at peripheral velocities optimized by the control section 702.

In the adjustment mode, the control section 702 set the peripheral velocity ratio St of the upstream development roller to 1.6, and varied the peripheral velocity ratio Vr of the downstream development roller relative to the photosensitive drum in a range of 1.1-1.6, based on the value of the measured toner ratio of the developer.

Embodiment 6

In the first to fifth embodiments, the rotation of the development rollers 21 is "with-rotation", that is, such rotation that the direction in which the peripheral surface of the development roller 21 moves in the area of contact between the development roller 21 and photosensitive drum 3, is the same as the direction in which the peripheral surface of the photosensitive drum 3 moves in the area of contact, and the rotation of the development roller 31 also is "with-rotation" that is, such rotation that the direction in which the peripheral surface of the development roller 31 moves in the area of contact between the development roller 31 and photosensitive drum 3, is the same as the direction in which the peripheral surface of the photosensitive drum 3 moves in the area of contact rotated. However, these embodiments are not intended to limit the present invention in terms of the rotational direction of the development rollers 21 and 31. That is, the present invention is also applicable to an image forming apparatus (developing device), the direction in which the peripheral surface of each of its development rollers 21 and 31 moves in the area of contact between each development roller and the photosensitive drum is opposite to the direction in which the peripheral surface of the photosensitive drum moves in the area of contact.

Referring to FIG. 2(*a*), the photosensitive drum 3 of the image forming apparatus in the sixth embodiment of the present invention is rotated in the opposite direction from the direction indicated by the arrow mark R1. Thus, the primary transfer station, in which a toner image is transferred away from the photosensitive drum 3 is positioned higher than the development roller 21, and the optical sensor KS is positioned between the primary transfer station and the development roller 21. Also in the case of the image forming apparatus in this embodiment, the adherence of toner to the background can be prevented or minimized while keeping the adhesion of toner to the exposed portion of the electrostatic image, at or above the tolerable or higher level in terms of amount and quality, by setting the developing device of the apparatus so that the development roller 21 from which developer is transferred onto the development roller 31 is higher in peripheral velocity than the development roller 31, as in the first embodiment. That is, the development roller 21 which develops an electrostatic image with the use of its magnetic brush (formed of developer higher in toner ratio (toner-rich) is made higher in peripheral velocity to ensure the sufficient development performance, and the development roller 31 which develops the same electrostatic image with the use of its magnetic brush (formed of developer having been reduced in electrical resistance by toner consumption which occurred on development roller 21) is made lower in peripheral velocity to suppress the fog-preventing contrast reduction.

The development roller 21 and 31 of the image forming apparatus in the sixth embodiment are higher in the speed of their peripheral surface relative to the peripheral surface of the photosensitive drum, than those of the image forming apparatus in the first embodiment. Therefore, they are higher in the development performance than in the first embodiment. More specifically, the motors 50 and 60 rotate the development rollers 21 and 31 in such a manner that the peripheral surfaces of the development roller 21 and that of the development roller 31 move in the opposite direction from the peripheral surface of the photosensitive drum 3 in the area of contact between the development rollers 21 and 31, and the photosensitive drum 3, and the development rollers 21 and 31 are lower in peripheral velocity than the photosensitive drum 3. Further, the motors 50 and 60 rotationally drive the development rollers 21 and 31 so that the development roller 31 becomes slower in peripheral velocity than the development roller 21.

As will be evident from the detailed description of the embodiments of the present invention given above, the present invention which is related to an image forming apparatus which employs a developing device having two development rollers can prevent or minimize the problem that the developing device adheres toner to the background, while ensuring that toner is sufficiently adhered to the exposed portion of the electrostatic image, even if the apparatus is increased in process speed.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 040054/2012 filed Feb. 27, 2012 which is hereby incorporated by reference.

What is claimed is:

1. An image forming apparatus comprising:

a photosensitive member rotatable at a process speed of not less than 500 mm/sec;

a first developer carrying member for carrying a developer comprising toner and a carrier having a volume resistivity $10^6$-$10^{10}$ Ωcm and for developing an electrostatic image formed on said photosensitive member by rubbing said photosensitive member with the developer carried on said first developer carrying member;

a second developer carrying member for carrying the developer received from said first developer carrying member and for developing the electrostatic image by rubbing said photosensitive member with the developer carried on said second developer carrying member;

wherein said first developer carrying member is provided with a first magnetic pole at a position opposed to said second developer carrying member and a second magnetic pole having the same magnetic polarity as the first magnetic pole at a position downstream and adjacent to the first magnetic pole with respect to a rotational direction of said first developer carrying member, wherein said second developer carrying member is provided with a third magnetic pole at a position opposed to said first developer carrying member and a fourth magnetic pole having the same magnetic polarity as the third magnetic pole at a position upstream and adjacent to said third magnetic pole with respect to a rotational direction of said second developer carrying member, wherein said second developer carrying member is disposed downstream of said first developer carrying member with respect to a rotational direction of said photosensitive member;

a voltage source for applying a developing bias voltage comprising a DC voltage component and an AC voltage component to said first developer carrying member and second developer carrying member; and a driving device for rotating said first developer carrying member at a peripheral speed higher than that of said photosensitive member and for rotating said second developer carrying member at a peripheral speed which is higher than that of said photosensitive member and which is lower than that of said first developer carrying member.

2. An apparatus according to claim 1, further comprising a controller for controlling the peripheral speed of said second developer carrying member so that the peripheral speed of the second developer carrying member decreases with decrease of a toner ratio of the developer carried on said second developer carrying member.

3. An apparatus according to claim 1, further comprising a potential sensor for detecting potential information of a surface of said photosensitive member, and a controller for controlling the peripheral speed of said second developer carrying member on the basis of the potential information so that the peripheral speed of said second developer carrying member decreases with decrease of a potential difference between a potential of a non-image portion detected after passage of a position opposed to said second developer carrying member and a DC voltage applied on said second developer carrying member.

4. An apparatus according to claim 1, further comprising a current detecting sensor for detecting current information corresponding to a current flowing between said second developer carrying member and said photosensitive member, and a controller for controlling the peripheral speed of said second developer carrying member on the basis of a DC current flowing through said second developer carrying member at the time when a non-image portion passes at a position opposed to said second developer carrying member.

5. An apparatus according to claim 3, wherein said controller operates, during a non-image-formation period, said apparatus in a setting mode for setting a peripheral speed of the second developer carrying member on the basis of a difference between a potential of a non-image portion of said photosensitive member detected after passing a position opposed to said second developer carrying member in a state that the toner on said second developer carrying member is consumed, and a potential of the non-image portion of said photosensitive member detected after passing the position opposed to said second developer carrying member in a state that the toner on said second developer carrying member is not consumed.

6. An apparatus according to claim 2, further comprising a toner ratio detecting sensor for detecting toner ratio information of the developer before being carried on said first developer carrying member, wherein said controller controls said driving device on the basis of the toner ratio information so that the peripheral speed of said second developer carrying member decreases with decrease of the toner ratio of the developer before being carried on said first developer carrying member.

7. An apparatus according to claim 1, wherein the peripheral speed of said first developer carrying member Vt [mm/sec], the peripheral speed of said second developer carrying member Vr [mm/sec], and the peripheral speed of said photosensitive member Vd satisfy, $$1.1<Sr<St<1.5$$

where Sr=Vr/Vd, and St=Vt/Vd.

8. An apparatus according to claim 7, wherein an intensity of magnetization of the carrier in a magnetic field of 1000/4π [kA/m] is not less than 50 [$Am^2$/kg] and not more than 70 [$Am^2$/kg].

9. An apparatus according to claim 1, wherein a particle size of the toner $r_t$ [μm], a true density of the toner $\rho_t$ [g/$cm^3$], a particle size of the carrier $r_c$ [μm], a true density of the carrier $\rho_c$ [g/$cm^3$], a weight ratio of the toner in the developer x [%], a coverage ratio S satisfy, $$20\% \le S \le 90\%$$

where $$S\ (\%) = \frac{\rho_c r_c x}{4\rho_t r_t (100 - x)} \times 100.$$

10. An apparatus according to claim 1, wherein a volume resistivity of a surface layer of said photosensitive member is not less than $1\times10^9$ [Ω cm] and not more than $1\times10^{14}$ [Ω cm].

11. An image forming apparatus comprising:

a photosensitive member rotatable at a process speed of not less than 500 mm/sec;

a first developer carrying member for carrying a developer comprising toner and a carrier having a volume resistivity $10^6$-$10^{10}$ Ωcm and for developing an electrostatic image formed on said photosensitive member by rubbing said photosensitive member with the developer carried on said first developer carrying member;

a second developer carrying member for carrying the developer received from said first developer carrying member and for developing the electrostatic image by rubbing said photosensitive member with the developer carried on said second developer carrying member;

wherein said first developer carrying member is provided with a first magnetic pole at a position opposed to said second developer carrying member and a second magnetic pole having the same magnetic polarity as the first magnetic pole at a position downstream and adjacent to the first magnetic pole with respect to a rotational direction of said first developer carrying member, wherein said second developer carrying member is provided with a third magnetic pole at a position opposed to said first developer carrying member and a fourth magnetic pole having the same magnetic polarity as the third magnetic pole at a position upstream and adjacent to said third magnetic pole with respect to a rotational direction of said second developer carrying member, wherein said first developer carrying member is disposed downstream of said second developer carrying member with respect to a rotational direction of said photosensitive member;

a voltage source for applying a developing bias voltage comprising a DC voltage component and an AC voltage component to said first developer carrying member and second developer carrying member; and a driving device for rotating said first developer carrying member and said second developer carrying member such that peripheral moving directions thereof are the opposite to a peripheral movement direction of said photosensitive drum at a position where they are opposed to each other and for rotating said second developer carrying member at a peripheral speed lower than that of said first developer carrying member.

* * * * *